US008485626B2

(12) United States Patent
Takeuchi et al.

(10) Patent No.: US 8,485,626 B2
(45) Date of Patent: Jul. 16, 2013

(54) IMAGE FORMING DEVICE AND METHOD FOR CONTROLLING DISCHARGE OF INK DROPLETS BASED ON SENSOR DETECTION

(75) Inventors: Shohgo Takeuchi, Kanagawa (JP); Manabu Izumikawa, Tokyo (JP); Shiho Shimosaka, Tokyo (JP); Atsushi Saitoh, Kanagawa (JP); Kazumi Kobayashi, Tokyo (JP); Shingo Shiramura, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 247 days.

(21) Appl. No.: 12/880,617

(22) Filed: Sep. 13, 2010

(65) Prior Publication Data

US 2011/0063353 A1 Mar. 17, 2011

(30) Foreign Application Priority Data

Sep. 14, 2009 (JP) ..... 2009-212508
Feb. 2, 2010 (JP) ..... 2010-021598

(51) Int. Cl.
*B41J 29/38* (2006.01)

(52) U.S. Cl.
USPC ..... 347/14

(58) Field of Classification Search
None
See application file for complete search history.

(56) References Cited

U.S. PATENT DOCUMENTS 5,096,044 A * 3/1992 Biebel ..... 198/502.4
6,909,516 B1 * 6/2005 Hoover ..... 356/615

FOREIGN PATENT DOCUMENTS

| | | | |
|---|---|---|---|
| JP | 11-65219 | | 3/1999 |
| JP | 2001-287377 | | 10/2001 |
| JP | 2005-225207 | | 8/2005 |
| JP | 2005225207 A | * | 8/2005 |
| JP | 2010-94814 | | 4/2010 |

* cited by examiner

*Primary Examiner* — Geoffrey Mruk
*Assistant Examiner* — Bradley Thies
(74) *Attorney, Agent, or Firm* — Oblon, Spivak, McClelland, Maier & Neustadt, L.L.P.

(57) ABSTRACT

An image forming device includes: an endless transport belt in which a plurality of through holes are formed, the transport belt circulating to carry sheets; a recording head with a plurality of nozzles through which ink droplets are discharged, the nozzles being arranged in a width direction of the transport belt. The image forming device performs preliminary discharge of ink droplets in which the ink droplets discharged through the nozzles pass through the through holes. The image forming device further includes: a sensor that detects an element to be detected formed on the transport belt when the transport belt circulates; and a preliminary discharge control unit that controls timings of discharge of ink droplets through the nozzles in the preliminary discharge based on a plurality of results of detecting the elements to be detected given from the sensor.

20 Claims, 22 Drawing Sheets

IMAGE FORMING DEVICE AND METHOD FOR CONTROLLING DISCHARGE OF INK DROPLETS BASED ON SENSOR DETECTION

CROSS-REFERENCE TO RELATED APPLICATIONS

The present application claims priority to and incorporates by reference the entire contents of Japanese Patent Application No. 2009-212508 filed in Japan on Sep. 14, 2009 and Japanese Patent Application No. 2010-021598 filed in Japan on Feb. 2, 2010.

BACKGROUND OF THE INVENTION

1. Field of the Invention

The present invention relates to an image forming device.

2. Description of the Related Art

Conventionally used image forming devices include what we call ink-jet image forming devices that discharges ink droplets through a nozzle of a recording head. Japanese Patent Application Laid-open No. 2005-225207 (hereinafter called "Patent Document 1") discloses a type of the ink-jet image forming devices. The ink-jet image forming device disclosed in Patent Document 1 performs preliminary discharge of ink droplets through the nozzle in the absence of sheets in order to prevent problems such as attachment of foreign substances to the nozzle of the recording head, which may result in ink jam, defect in the amount of discharge, defect in a recording position (direction in which ink is discharged), etc. The aforementioned preliminary discharge allows removal of the foreign substances attached to the nozzle.

In the image forming device disclosed in Patent Document 1, ink droplets are discharged toward a large number of through holes (suction holes) defined in a transport belt, and pass through the through holes during the preliminary discharge. That is, in the preliminary discharge, ink droplets are discharged through nozzles overlapping the through holes, thereby preventing attachment of ink droplets to the transport belt to be caused as a result of the preliminary discharge. Furthermore, while the transport belt is caused to circulate, ink droplets are discharged through every nozzle in the preliminary discharge by sequentially changing nozzles to be used to discharge ink droplet as nozzles overlapping the through holes change.

When deformation (such as stretch or contraction) is generated in the transport belt as a result, for example, of its exhaustion, the positions of the through holes are changed from their initial positions at the start of use of the image forming device. Accordingly, if the timing of preliminary discharge is the same as that of an initial stage at the start of the use, ink droplets may attach to the transport belt. In order to avoid this, in the conventional image forming device, the range into which ink is discharged is set narrower with respect to the size of the through holes. By doing so, ink droplets do not attach to the transport belt even when the through holes slightly shift from their initial positions as a result, for example, of deformation of the transport belt.

However, narrowing the range into which the preliminary discharge is performed with respect to the size of the through holes reduces the number of nozzles through which ink droplets are discharged to each of the through holes at a time in the preliminary discharge. This in turn requires longer time in completing the preliminary discharge through every nozzle.

SUMMARY OF THE INVENTION

It is an object of the present invention to at least partially solve the problems in the conventional technology.

According to an aspect of the present invention there is provided an image forming device including: an endless transport belt in which a plurality of through holes are formed, the transport belt circulating to carry sheets; a recording head with a plurality of nozzles through which ink droplets are discharged, the nozzles being arranged in a width direction of the transport belt. The image forming device performs preliminary discharge of ink droplets in which the ink droplets discharged through the nozzles pass through the through holes. The image forming device further includes: a sensor that detects an element to be detected formed on the transport belt when the transport belt circulates; and a preliminary discharge control unit that controls timings of discharge of ink droplets through the nozzles in the preliminary discharge based on a plurality of results of detecting the elements to be detected given from the sensor.

According to another aspect of the present invention there is provided an image forming device including: an endless transport belt in which a plurality of through holes are formed, the transport belt circulating to carry sheets; a recording head with a plurality of nozzles through which ink droplets are discharged, the nozzles being arranged in a width direction of the transport belt. The image forming device performs preliminary discharge of ink droplets in which the ink droplets discharged through the nozzles passing through the through holes. The image forming device further includes: a sensor that detects elements to be detected formed on the transport belt when the transport belt circulates; a first type of elements to be detected included in the elements to be detected, a detected position of the first type of elements to be detected in the width direction of the transport belt changing in a longitudinal direction of the transport belt; and a preliminary discharge control unit that causes the preliminary discharge of ink droplets through the nozzles into the through holes at a timing determined based on a result of detecting the first type of elements to be detected, given from the sensor. The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
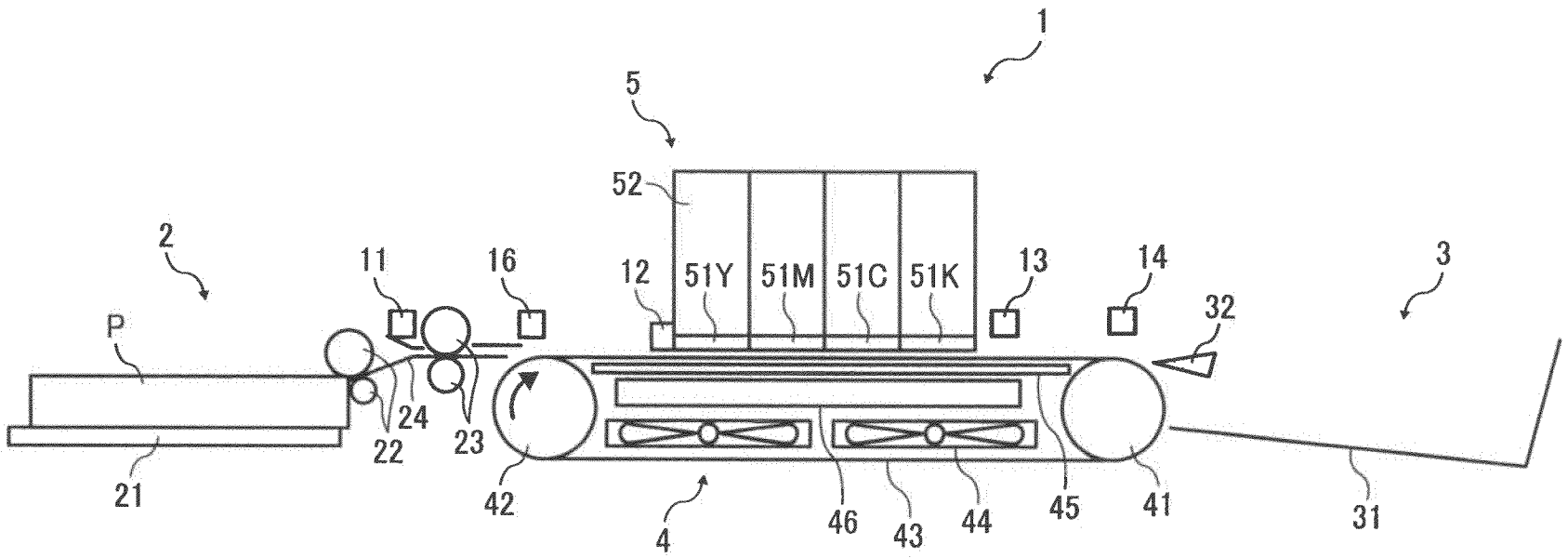
FIG. 1 is a diagram illustrating an outline of the structure of an image forming device according to a first embodiment of the present invention.

Next, embodiments of the present invention will be described by referring to the drawings. Image forming devices according to embodiments described below have common constituent elements. These constituent elements will be denoted by the same reference numerals, and an overlapped explanation will be omitted.

<First Embodiment>

An image forming device according to a first embodiment will now be described by referring to FIGS. 1 to 14. An image forming device 1 is an in-line image forming device including a sheet feeding unit 2, a sheet ejecting unit 3, a transport unit 4, and an image forming unit 5. The sheet feeding unit 2 holds sheets P piled thereon, and supplies the sheets P. The sheet ejecting unit 3 ejects printed sheets P, and holds the ejected sheets P piled thereon. The transport unit 4 carries sheets P from the sheet feeding unit 2 to the sheet ejecting unit 3. The image forming unit 5 discharges an ink droplet onto a sheet P being carried by the transport unit 4 to form an image thereon.

The sheet feeding unit 2 includes: a sheet feeding tray 21 on which sheets P are piled; sheet feed roller pair 22 that supplies sheets P one by one from the sheet feeding tray 21; resist roller pair 23; and a guide member 24 that guides the transport of sheets P.

The sheet ejecting unit 3 includes a sheet eject tray 31 for holding sheets P piled thereon received through a jump table 32. The jump table 32 guides the lower surfaces of sheets P received from a transport belt 43, and smoothly transfers the sheets P to the sheet eject tray 31.

The transport unit 4 includes the endless transport belt 43, sucking unit 44 such as a sucking fan, a platen member (anti-distortion member) 45, and a preliminary discharge ink receiver 46. The transport belt 43 is stretched between a driving roller (transport roller) 41 and a driven roller 42. The sucking unit 44 sucks air through suction holes (through holes) 201 formed in the transport belt 43 to hold sheets P on the transport belt 43 under suction. The platen member 45 supports the transport belt 43 from the rear at a position opposite to the image forming unit 5. The preliminary discharge ink receiver 46 receives droplets (waste liquid) discharged in preliminary discharge. Sheets P are attached to the transport belt 43 under air suction, and are carried in a direction from left to right in FIG. 1 as the transport belt 43 circulates in a direction indicated by an arrow in FIG. 1.

The image forming unit 5 includes a head module array 50 with recording heads 51 (51Y, 51M, 51C and 51K) for four colors (yellow (Y), magenta (M), cyan (C) black (K)) arranged in a line from which droplets of ink of four colors are discharged respectively onto a sheet P being carried while held on the transport belt 43 under suction. The image forming unit 5 also includes a dispensing member 52 that dispenses ink, stored in an ink tank such as a sub tank not shown, to each of the recording heads 51.

Figure 3:
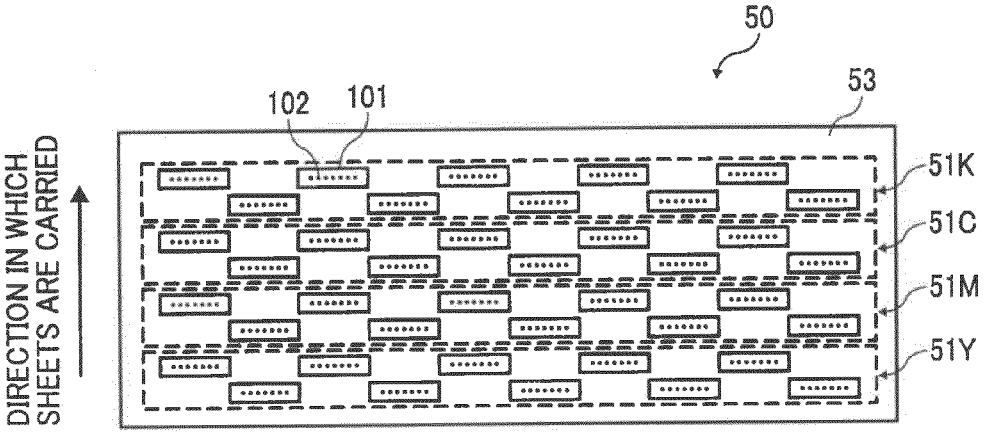
FIG. 3 is a plan view illustrating an exemplary head module.

As shown in FIG. 3, the head module array 50 of the image forming unit 5 includes a plurality of heads 101 each having a nozzle array in which a plurality of nozzles 102 are arranged. The heads 101 are arranged on a common base member 53 in a staggered manner in a direction crossing (herein, perpendicular to) a direction in which sheets are carried (namely, the heads 101 are arranged in the width direction of the transport belt 43). The recording heads 51 of the respective colors are each composed of the plurality of (herein, ten) heads 101 arranged in two staggered lines. Hereinbelow, a direction in which the heads 101 are arranged is called a "head array direction." Further, each array of all of the nozzles of the plurality of heads 101 arranged in a direction crossing the direction in which sheets are carried is called a "nozzle array in a recording head."

Figure 4:
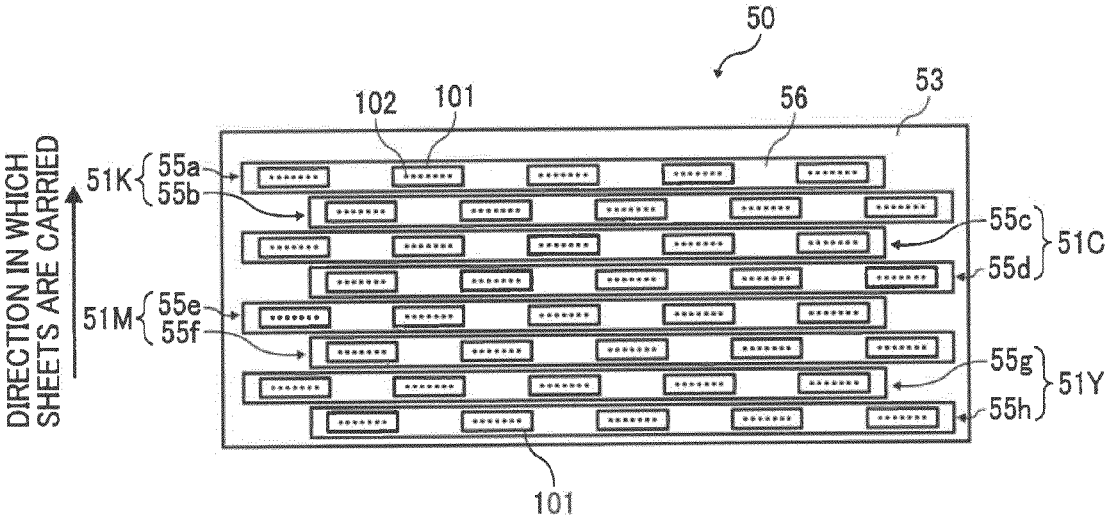
FIG. 4 is a plan view illustrating another exemplary head module.

The structure of the head module array 50 is not limited to that described above. As an example, the head module array 50 may be composed of eight head modules 55*a* to 55*h* arranged on the common base member 53 in the direction in which sheets are carried as shown in FIG. 4. In this case, the head modules 55*a* to 55*h* each include a plurality of (in this example, five) heads 101 provided on a corresponding base member 56. The arrangement of the head modules 55*a* to 55*h* is configured such that the heads 101 are arranged in a staggered manner between two ones of the head modules 55 adjacent to each other in the direction in which sheets are carried.

Figure 5:
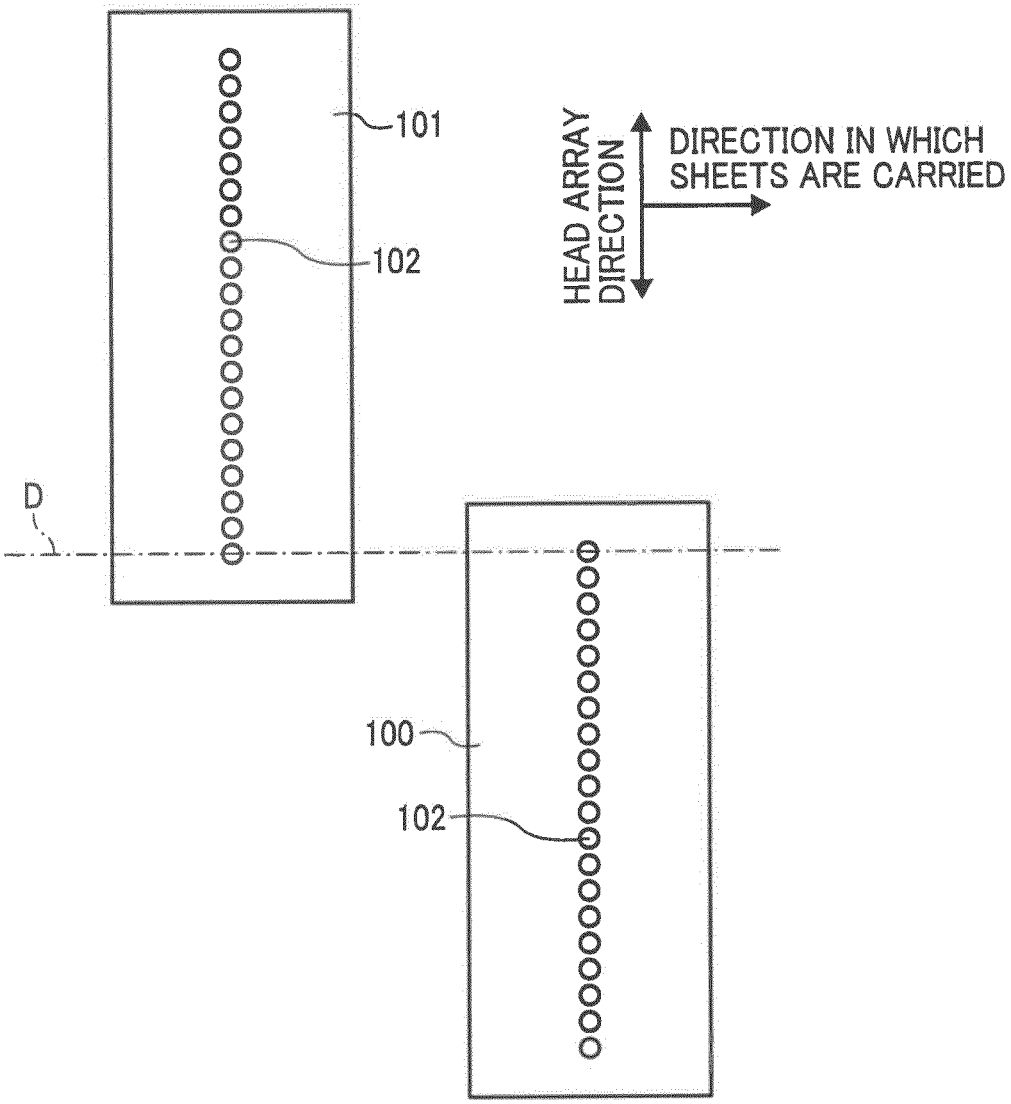
FIG. 5 is a schematic view illustrating overlapping portions of heads.

In the present embodiment, as shown in FIG. 5, the arrangement of the heads 101 is configured such that one, or two or more nozzles 102 at the respective end portions of two ones of the heads 101 adjacent to each other in the head array direction overlap each other. This allows the nozzles 102 in the two heads 101 to make recording in the same recording position (in the same dot position).

Turning back to FIGS. 1 and 2, a first sheet detection unit 11 is provided on the upstream side of the direction in which sheets are carried (hereinafter simply called an "upstream side") with respect to the resist rollers 23. The first sheet detection unit 11 is used to control timing of drive of the sheet feed rollers 22 that supplies sheets P one by one, and to read the position and the size of the sheets P. A recording position detection unit 12 is provided on the upstream side of the image forming unit 5. The recording position detection unit 12 is used to determine a time of discharge of droplets from the recording heads 51, and to detect the rear end of the sheets. A second sheet detection unit 13 used to read the position of a sheet P is provided on the downstream side of the image forming unit 5. A sheet end detection unit 14 used to detect a jam of the sheets P and to determine a timing of supply of a subsequent sheet P is provided above the driving roller (transport roller) 41.

Figure 2:
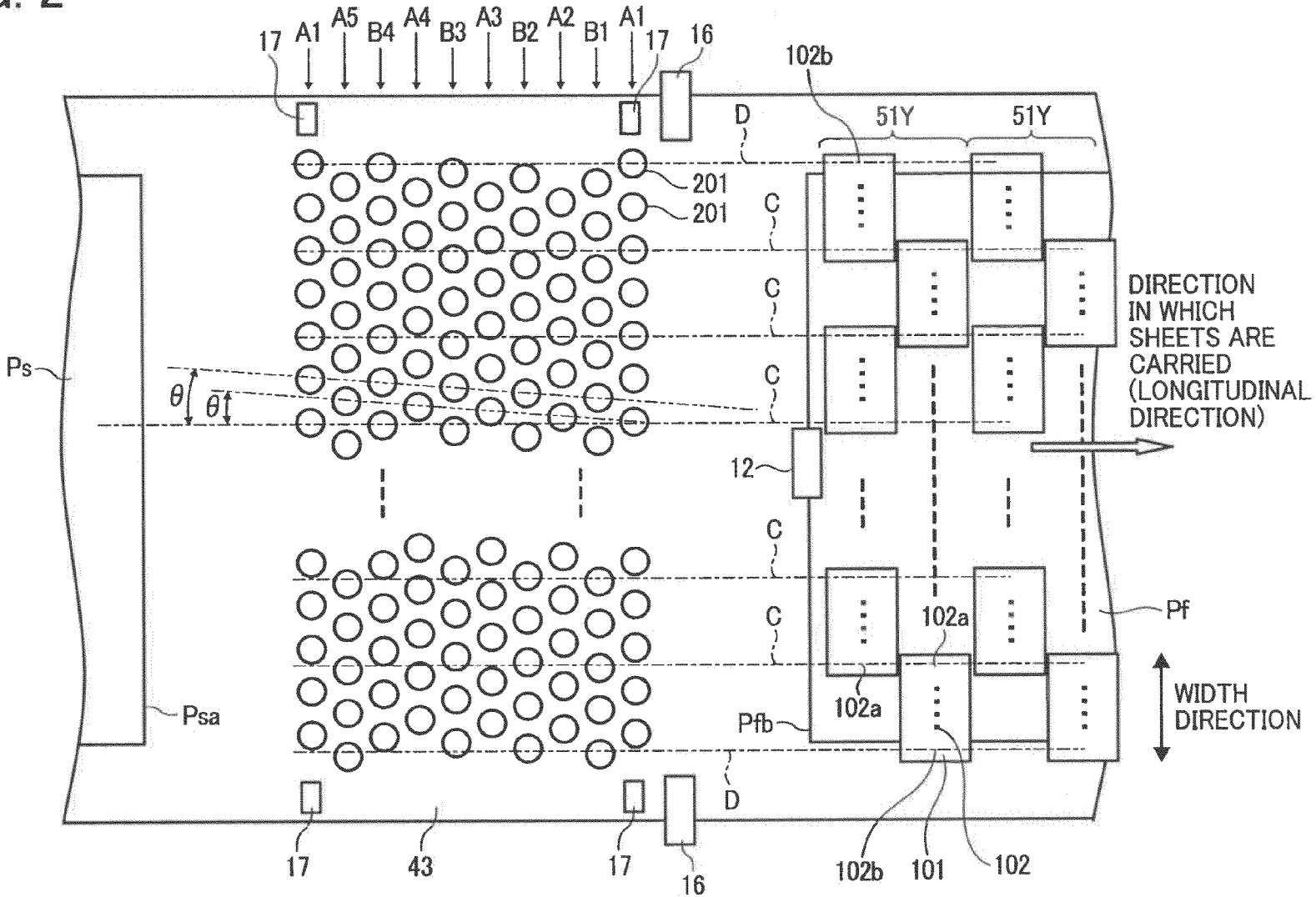
FIG. 2 is a plan view of a transport belt in which through holes are formed.

As shown in FIG. 2, marks (markers or elements to be detected) 17 are formed on the transport belt 43 in corresponding relationship with reference hole rows in the belt to enable the reference hole rows in the belt to be recognized. Further, sensors 16 used to detect the marks 17 are provided as shown in FIGS. 1 and 2.

Figure 6:
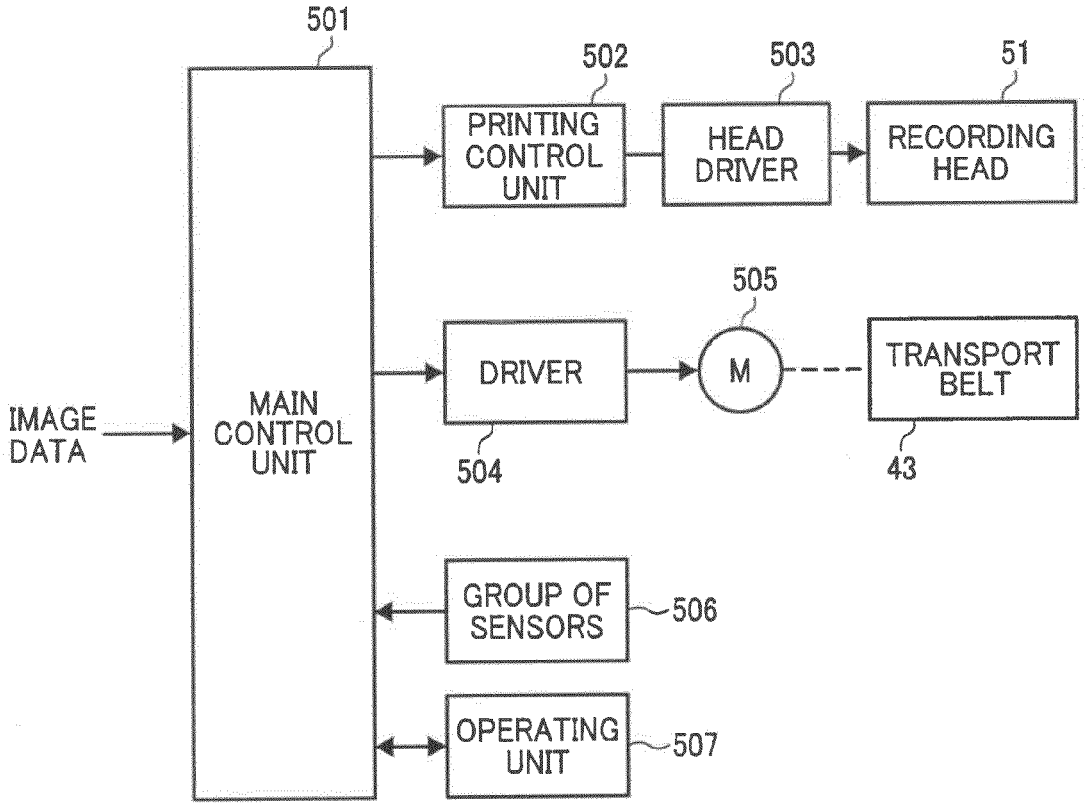
FIG. 6 is a block diagram illustrating an outline of the structure of a control unit.
Figure 8:
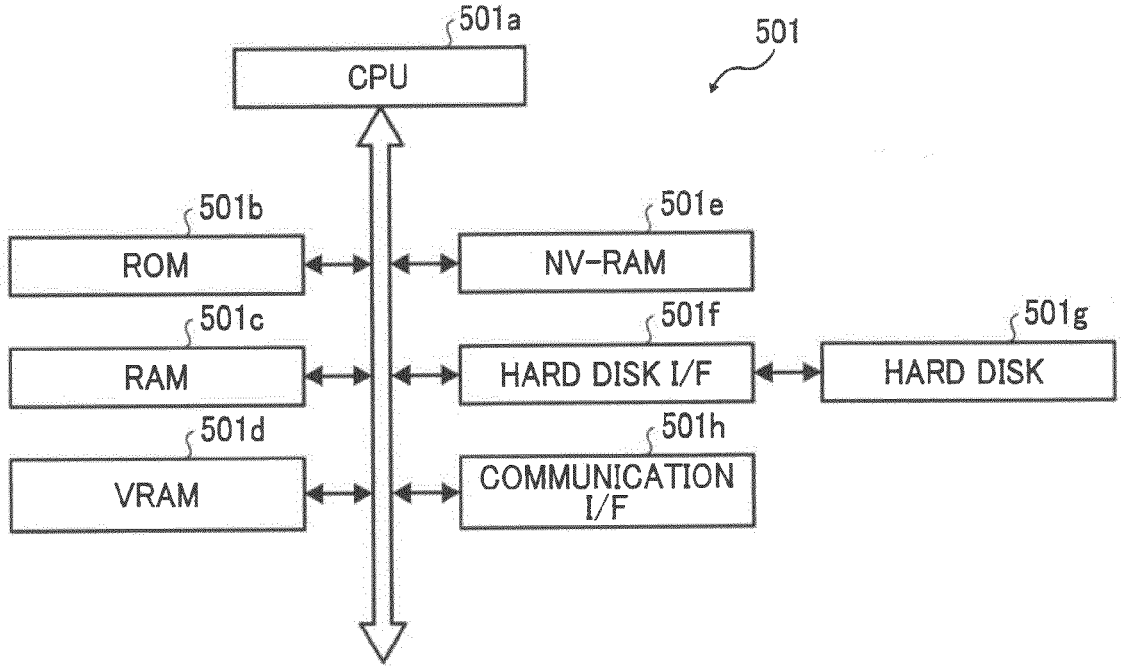
FIG. 8 is a block diagram illustrating an outline of the structure of a main control unit.

The outline of a control unit of the image forming device will be described next by referring to the explanatory block diagram of FIG. 6. A main control unit (system controller) 501 includes a CPU (central processing unit) 501*a*, a VRAM (video random access memory) 501*d*, a communication interface 501*h* (all of which are shown in FIG. 8) and other components. The CPU 501*a* functions as a control unit responsible for overall control and control relating to preliminary discharge. The main control unit 501 transfers printing data to a printing control unit 502 to form an image on a sheet based on image data and command information of various types transmitted, for example, from an external information processing device (host).

Based on a printing data signal received from the main control unit 501, the printing control unit 502 creates data for driving a pressure generating unit that causes discharge of droplets through the nozzles 102 of the recording heads 51. The printing control unit 502 also transfers various signals and others to a head driver 503 required for purposes such as transfer of the created data and confirmation of the data transfer. The printing control unit 502 includes a storage unit functioning as driving waveform data storage unit, a driving waveform generating unit, a selecting unit (all of which are not shown), and other components. The driving waveform generating unit includes a D/A converter for D/A conversion of data of a driving waveform, a voltage amplifier, a current amplifier, and other components. The selecting unit selects a driving waveform to be applied to the head driver 503. The printing control unit 502 creates a driving waveform with one or more driving pulses (driving signals), and outputs the created driving waveform to the head driver 503, thereby controlling drive of the recording heads 51.

The main control unit 501 controls drive of a sheet feed motor 505 that causes circulating motion of the transport belt 43, a motor for driving the sucking unit 44 and the like through a motor driver 504. Although not shown, the main control unit 501 also performs other controls such as controlling drive of a sheet feeding motor for supplying sheets P from the sheet feeding unit 2.

The main control unit 501 receives detection signals given from a group of sensors 506 including the aforementioned detection units and sensors 11 to 16 and other sensors of various types. Furthermore, the main control unit 501 gives and receives information of various types including that to be displayed to and from an operating unit 507.

The image forming operation of the image forming device will be described next. Image data to be printed is entered from the information processing device through the communication interface 501*h* (see FIG. 8) of the main control unit 501, and is then stored in an image memory such as the VRAM 501*d* (see FIG. 8). The main control unit 501 causes a sheet feed driver not shown to drive the sheet feed roller pair 22 so that only the uppermost one of sheets P placed on the sheet feeding tray 21 is supplied toward the resist rollers 23, and causes the transport belt 43 to start its circulating motion at a predetermined time.

Next, the main control unit 501 receives a sheet detection signal from the first sheet detection unit 11. Then, after elapse of a certain period of time, the main control unit 501 drives the resist rollers 23, and transfers the sheet P onto the transport belt 43.

After being notified of the fact that the leading end of the sheet P has reached a sensor of the recording position detection unit 12, the main control unit 501 causes discharge of droplets onto the sheet P having been carried according to the image data at a predetermined time through each of the recording heads 51. As a result, an image is formed on the sheet P. That is, image data stored in an image memory such as the VRAM 501*d* is transferred to the printing control unit 502, and is converted to dot data of each color thereat. The recording heads 51 are driven through the head driver 503 in response to the created dot data. As a result, necessary droplets are discharged through the nozzles 102.

Based on a result of detection given from the recording position detection unit 12, discharge of droplets from the recording heads 51 is timed to occur in synchronization with the speed at which the sheet P is carried. Thus, an image can be formed on the sheet P without stopping transport of the sheet P.

The sheet P on which the image has been formed continues to be carried by the transport belt 43, and is transferred onto the sheet eject tray 31 of the sheet ejecting unit 3.

The structure of the image forming device relating to preliminary discharge will be described next. As shown in FIG. 2, the plurality of suction holes 201 are provided in the transport belt 43, and are arranged such that they pass through positions opposite to all the nozzles 102 of each of the recording heads 51. Here, each row of the suction holes 201 arranged in the head array direction is called a "suction hole row." In this example, suction hole rows A1 to A5 (collectively called "suction hole rows A" when distinction therebetween is not necessary) and suction hole rows B1 to B4 (collectively called "suction hole rows B" when distinction therebetween is not necessary) are alternately arranged at certain intervals from the downstream side to the upstream side of the direction in which sheets are carried, namely from right to left in FIG. 2.

As shown in FIG. 2, the suction holes 201 of the suction hole rows A and B are arranged such that both of the respective centers thereof are placed on virtual line segments each having a certain angle θ with respect to the direction in which sheets are carried, and are spaced at certain intervals in a direction perpendicular to the direction in which sheets are carried. Accordingly, in the present embodiment, nine rows of suction holes including the suction hole rows A1 to A5 and B1 to B4 are allowed to pass through positions opposite to all the nozzles 102 of each of the recording heads 51.

All the suction holes 201 have the same size (hole diameter). Accordingly, a number of nozzles, through which droplets are discharged towards each of the suction holes 201, is set to a predetermined constant number. However, for nozzles 102*a* at overlapping portions (overlapping portions in the direction in which nozzles are arranged) generated due to the staggered arrangement of the heads 101 of each of the recording heads 51, or for nozzles 102*b*, which are located at end portions of nozzle arrays of the recording heads 51 and are less-frequently used (nozzles 102*b* are those formed at the end portions of the nozzle arrays of the recording heads 51), the number of nozzles through which droplets are discharged toward corresponding one of the suction holes 201 is set about half the aforementioned number. The number of nozzles 102*a* or 102*b* at each part is not limited to one but may be two or more.

That is, at each of the heads 101 on the upstream and downstream sides of the direction in which sheets are carried, the number of the nozzles 102 for preliminary discharge toward one of the suction holes 201 corresponding to each of the overlapping portions of the heads 101 is half the number of the nozzles 102 for preliminary discharge toward one of the suction holes 201 in normal portions other than the overlapping portions. The number of nozzles for preliminary discharge in each of the overlapping portions is eventually approximately the same as the number of nozzles for preliminary discharge in the normal portions.

Although not shown, the suction hole rows A and B including A1, B1, A2 and others are arranged next to the suction hole row A5 so that the suction hole rows A and B are repeatedly arranged in the same manner as that described above.

In the suction hole row A1 among the suction hole rows A and B include the following two suction holes 201, one of the suction holes 201 is arranged such that a center thereof is located on each of line segments C and D. The line segments C extend in a direction parallel to the direction in which sheets are carried and pass through the nozzles 102*a* at the overlapping portions between two of the heads 101 generated by the staggered arrangement of the heads 101. The line segments D extend in a direction parallel to the direction in which sheets are carried and pass through the less-frequently used nozzles 102*b* at end portions in the head array direction (end portions of the recording heads 51). In FIG. 2, such suction holes 201 are indicated by bold lines.

The suction hole row A1 with the suction holes 201 passing through positions opposite to the end portions of the recording heads 51 and to the nozzles 102*a* at the overlapping portions of two of the heads 101 in the head array direction is identified as a reference suction hole row (reference hole row). In order to detect locations of the reference hole rows, the aforementioned marks (elements to be detected) 17 are provided at side edge portions (end portions in the head array direction) of the transport belt 43, and are detected by the sensors 16. The marks 17 correspond to the reference suction hole rows (reference hole rows) A1 formed at regular intervals around the total circumference of the transport belt 43, and are provided likewise at regular intervals.

A preliminary discharge operation of the image forming device 1 will be described next. When the frequency of use of a specific one of the nozzles 102 is lowered and ink droplets are not discharged therethrough for a certain period of time during printing or in a standby state, ink solvent near the nozzle evaporates to increase ink viscosity. In this condition, ink droplets may be impossible to be discharged through the nozzle 102 even by operating an actuator (not shown) of the head 101. In order to avoid this condition, the head 101 is driven to put the actuator into operation in a viscosity range in which ink droplets can be discharged, thereby performing preliminary discharge to eject the degraded ink (of high viscosity near the nozzle). The preliminary discharge is timed to occur when a predetermined time elapses, or recording is performed a predetermined number of times while the nozzle is not operated.

More specifically, after a recording operation is performed continuously until a predetermined period of time elapses, or the recording operation is performed a predetermined number of times, the main control unit (system controller) 501 detects the leading end of a sheet P to be carried next through the first sheet detection unit 11. Then, after the rear end of a sheet P being carried passes through a position to be detected by the recording position detection unit 12, the main control unit 501 causes the printing control unit 502 to transfer driving data according to a driving pattern for preliminary discharge to the head driver 503. Accordingly, ink droplets that do not contribute to recording (droplets for preliminary discharge) are discharged through the nozzles 102 of the recording head 51Y.

That is, an interval in transport between the rear end of a sheet P being carried and the leading end of a sheet P to be carried next is taken advantage of. When an interval between sheets P (sheet interval) is located at a position opposite to the recording head 51Y, droplets for preliminary discharge are discharged through the nozzles 102 of the recording head 51Y toward the suction holes 201 of the transport belt 43 at the sheet interval which are passing through positions opposite to the nozzles 102 of the recording head 51Y.

The droplets for preliminary discharge discharged toward the suction holes 201 in the transport belt 43 pass through the suction holes (through holes) 201 in the transport belt 43 and a through hole (not shown) defined in the anti-distortion member 45. The discharged droplets reach the preliminary discharge ink receiver 46 below the anti-distortion member 45. Thus, poor ink, which is dried or the viscosity of which has been changed due to being unused, is removed from the nozzles 102 of the recording head 51Y.

After the preliminary discharge from the nozzles 102 of the recording head 51Y, the suction holes 201 in the transport belt 43 move to positions opposite to the nozzles 102 of the recording heads 51M, 51C and 51K in this order, and droplets for preliminary discharge are discharged in the same manner from each of the recording heads 51M, 51C and 51K.

At this time, the main control unit 501 controls timing of discharge such that droplets for preliminary discharge are discharged from each of the recording heads 51M, 51C and 51K onto positions on the transport belt 43 substantially the same as positions of the suction holes 201 toward which droplets for preliminary discharge were discharged from the recording head 51Y. This means that, based on results of detection given from the recording position detection unit 12, the main control unit 501 causes preliminary discharge sequentially from the recording heads 51M, 51C and 51K towards substantially the same locations as the locations at which preliminary discharge from the recording head 51Y is performed, into the suction holes 201 in the transport belt 43. Shifts in times of preliminary discharges between the recording heads 51 are exactly the same as those of normal printing. However, timing in the normal printing and that in the preliminary discharge are different in the following. That is, a signal detected by the recording position detection unit 12 and used as a reference indicates the leading end of a sheet P in the normal printing. In contrast, a detected signal used as a reference indicates the rear end of a sheet P in the preliminary discharge operation.

Next, how preliminary discharge is performed toward the suction holes (suction holes opposite to the nozzles 102*a* at the overlapping portions generated by the staggered arrangement of the heads 101, and to the less-frequently used nozzles 102*b* at the end portions in the head array direction) 201 in the transport belt 43 when the suction holes 201 move in the direction in which sheets are carried will be described by referring to FIGS. 7A to 7D. In FIGS. 7A to 7D, those nozzles through which droplets for preliminary discharge are being discharged are indicated by black circles. Although not shown in FIGS. 7A to 7D, several droplets for preliminary discharge are generally discharged.

Figure 7A:
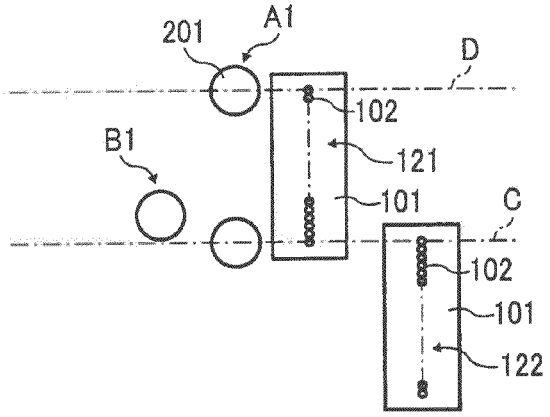
FIGS. 7A to 7D are views each illustrating an exemplary preliminary discharge operation.
Figure 7B:
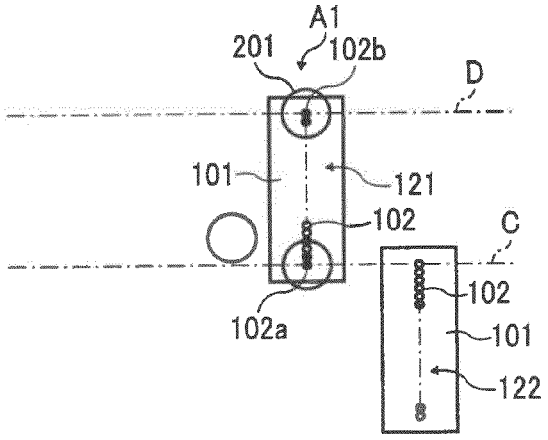

FIG. 7A shows a state immediately before the reference hole row A1 provided in the transport belt 43 reaches a nozzle array 121 to be used for preliminary discharge first. From this state, when the transport belt 43 moves, the reference hole row A1 reaches the nozzle array 121, as shown in FIG. 7B. Then, droplets for preliminary discharge are discharged through the two nozzles 102*a* at the overlapping portion of the heads 101, and through the two nozzles 102*b* at the end portion in the head array direction.

Figure 7C:
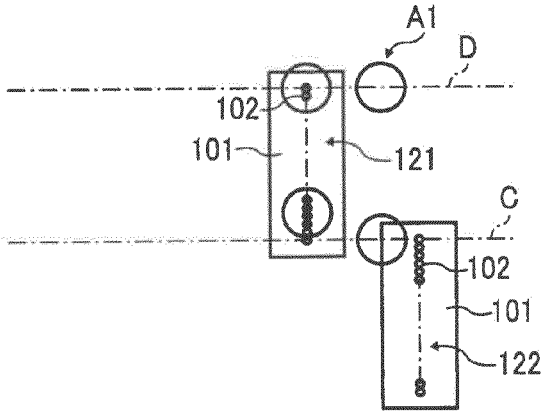
Figure 7D:
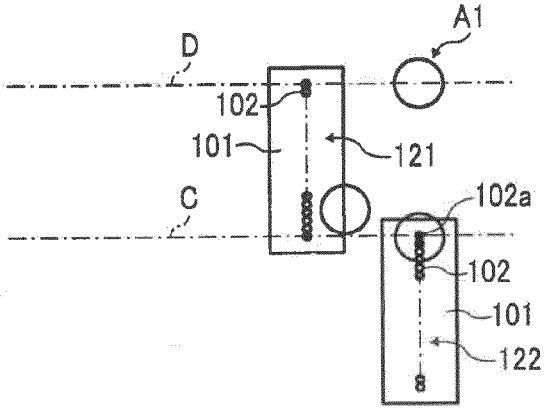

The suction hole row B1 next to the suction hole row A1 thereafter reaches the nozzle array 121, as shown in FIG. 7C. Then, droplets for preliminary discharge are discharged through four opposing nozzles 102. Next, the reference hole row A1 moves to a nozzle array 122 of the next head 101 arranged in the staggered manner as shown in FIG. 7D. Then, droplets for preliminary discharge are discharged through the two nozzles 102*a* at the overlapping portion of the heads 101.

Next, how preliminary discharge is controlled when the positions of the suction holes 201 serving as through holes are changed with time as a result of deformation and the like of the transport belt 43 will be described.

As shown in FIG. 8, the main control unit 501 includes: the CPU 501*a* as a main part of control; a ROM (read only memory) 501*b* in which information of various types specific to the image forming device 1 is stored; a RAM 501*c*; the VRAM 501*d* in which image data and the like are stored; an NV-RAM (non-volatile RAM) 501*e*; a hard disk interface 501*f*; a hard disk 501*g*; and a communication interface 501*h*. The NV-RAM 501*e* and the hard disk 501*g* are nonvolatile memories in which data is held regardless of whether the image forming device 1 is on or off. These constituent elements are connected to each other through a bus 501*i*.

The RAM 501*c* is used as a working area of the CPU 501*a*, as a receive buffer in which data received from an external device is stored, as an area in which processed images are expanded, and the like.

The communication interface 501*h* is an interface circuit that transmits and receives control signals and data received through a network from an external device, various signals to and from the image forming device 1, etc.

After turned on by a user, the image forming device 1 reads an OS from the hard disk 501*g*, writes the OS to the RAM 501*c*, and starts the OS. After started, the OS initiates an application program in response to a user's operation, and reads and writes information. The application program is not limited to the one that runs on a certain OS. An example of the application program may be such that it makes the OS perform part of processes described later. Another example thereof may be such that it is part of a group of program files for constituting a certain application program, OS and the like.

Generally, the application program to be installed on the hard disk 501*g* is stored in a storage medium such as a CD-ROM (not shown), and is installed from the storage medium to the hard disk 501*g*. Accordingly, a portable storage medium such as a CD-ROM also functions as a storage medium in which the application program is stored. The application program to be installed on the hard disk 501*g* may alternatively be taken from the outside, for example, through the communication interface 501*h*.

While stored in the hard disk 501*g* in the present embodiment, the application program, the OS and others may alternatively be stored in a computer-readable storage medium such as a semiconductor memory.

Figure 9:
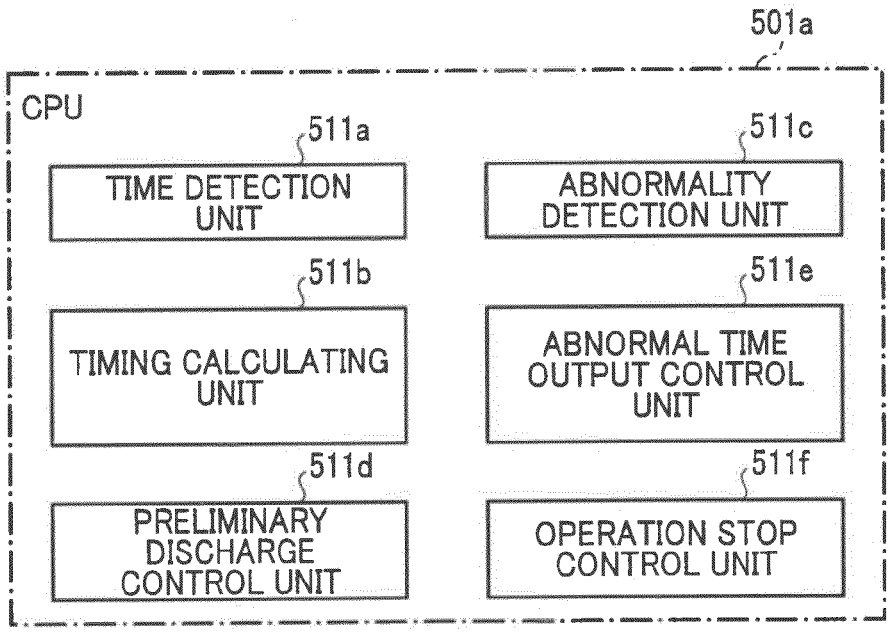
FIG. 9 is a block diagram illustrating a CPU.

In the present embodiment, as shown in FIG. 9, the CPU 501*a* executes the application program stored in the RAM 501*c*, by which the CPU 501*a* becomes operative to function as a time detection unit 511*a*, a timing calculating unit 511*b*, an abnormality detection unit 511*c*, a preliminary discharge control unit 511*d*, an abnormal time output control unit 511*e*, and an operation stop control unit 511*f*. That is, a program for the main control unit 501 contains respective modules that cause the CPU 501*a* to function as the time detection unit 511*a*, the timing calculating unit 511*b*, the abnormality detection unit 511*c*, the preliminary discharge control unit 511*d*, the abnormal time output control unit 511*e*, and the operation stop control unit 511*f*.

The time detection unit 511*a* determines times at which the marks 17 are detected based on results of detecting the marks 17 given from the sensors 16.

Based on times determined by the time detection unit 511*a* at which the plurality of marks 17 are detected, the timing calculating unit 511*b* calculates difference between the times at which the plurality of marks 17 are detected. Based on the calculated time difference, the timing calculating unit 511*b* determines timings (discharge timings) of preliminary discharge of ink droplets through the nozzles 102. A specific way of determining timings will be described later.

The abnormality detection unit 511*c* compares difference between times at which the plurality of marks 17 are detected with first and second thresholds Th1 and Th2 set in advance for the time differences. When the time difference are the same as or greater than the thresholds Th1 and Th2, the abnormality detection unit 511*c* determines that an abnormality is generated in the transport belt 43.

The preliminary discharge control unit 511*d* causes discharge of ink droplets through the nozzles 102 at timings determined by the timing calculating unit 511*b*.

When the abnormality detection unit 511*c* determines that an abnormality is generated in the transport belt 43, the abnormal time output control unit 511*e* causes a predetermined output unit to produce an output indicative of the abnormality. By way of example, the output unit displays or notifies (transmits) contents relating to the abnormality. As a specific example, the abnormal time output control unit 511*e* causes the operating unit 507 as the output unit having a display unit to present an image (including a sentence) indicating the occurrence of the abnormality. As another specific example, the abnormal time output control unit 511*e* causes the output unit to transmit a notification signal through the communication interface 501*h* to a server in a user support center or a terminal. Alternatively, as the output unit, a lamp, a buzzer and a speaker (all of which are not shown) may be provided.

When the abnormality detection unit 511*c* determines that an abnormality is generated in the transport belt 43, the operation stop control unit 511*f* stops at least part of the operation of the image forming device 1. This is because, the abnormality in the transport belt 43, when it is serious, may exert influence upon the image forming operation of the image forming device 1. In this case, the operation stop control unit 511*f* controls various parts in order to appropriately shut down a converter (not shown) that converts AC power to DC power, or a DC power line (not shown).

Figure 10:
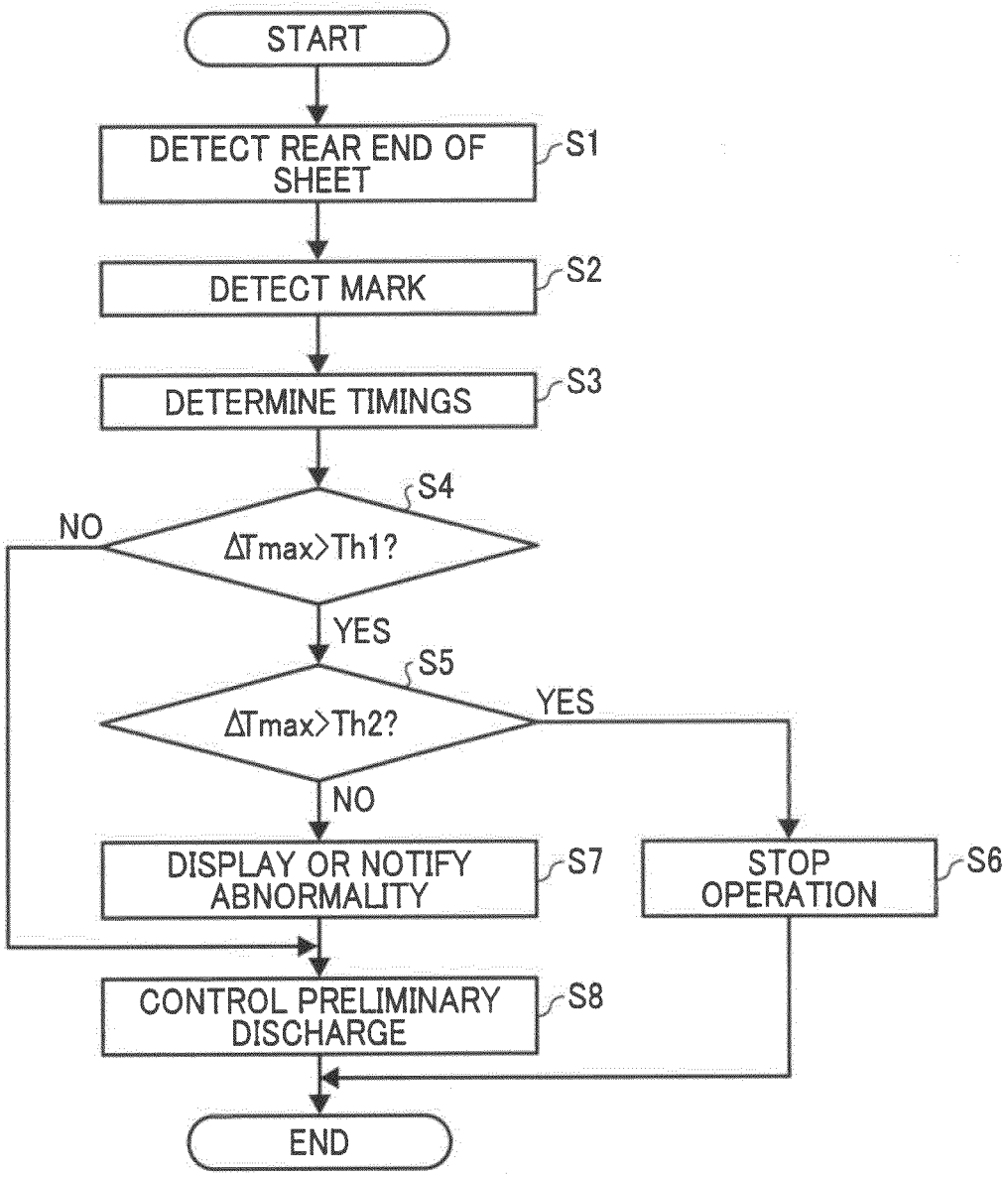
FIG. 10 is a flowchart illustrating exemplary procedure of preliminary discharge.

Next, the process flow of preliminary discharge control in the image forming device 1 will be described by referring to FIG. 10. First, when the recording position detection unit 12 detects the rear end of a sheet P as described above (step S1), the CPU 501*a* becomes operative to function as the time detection unit 511*a* to detect the marks 17 (step S2). The CPU 501*a* thereafter becomes operative to function as the timing calculating unit 511*b* to calculate difference between times at which the marks 17 are detected. Based on the calculated time difference, the CPU 501*a* determines timings (discharge timings) of preliminary discharge of ink droplets through the nozzles 102 (step S3).

Figure 11:
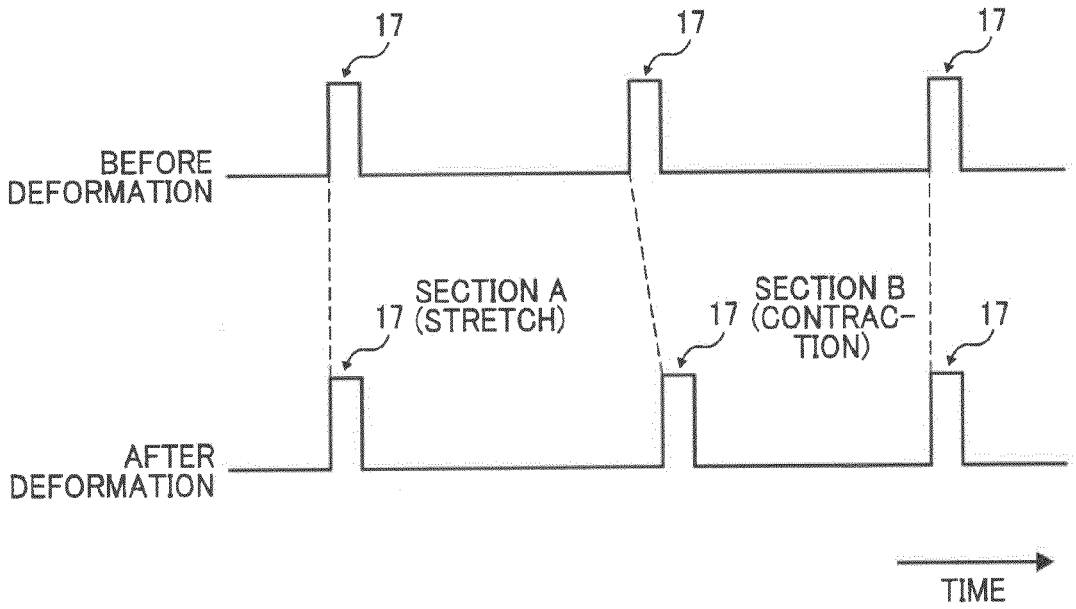
FIG. 11 is a schematic view illustrating an exemplary change of times at which elements to be detected are detected that is caused by deformation of the transport belt in its longitudinal direction.

An exemplary way of determining discharge timings will be described by referring to FIGS. 11 to 14. When deformation (such as stretch or contraction) is generated in the transport belt 43 in its longitudinal direction, as shown in FIG. 11, the transport belt 43 may "stretch" in a section A between two adjacent ones of the marks 17 while "contracting" in a section B between two adjacent ones of the marks 17 next to the section A. The main control unit 501 recognizes the "stretch" of the transport belt 43 by increase in time difference, and recognizes the "contraction" of the transport belt 43 by reduction in time difference.

Figure 12:
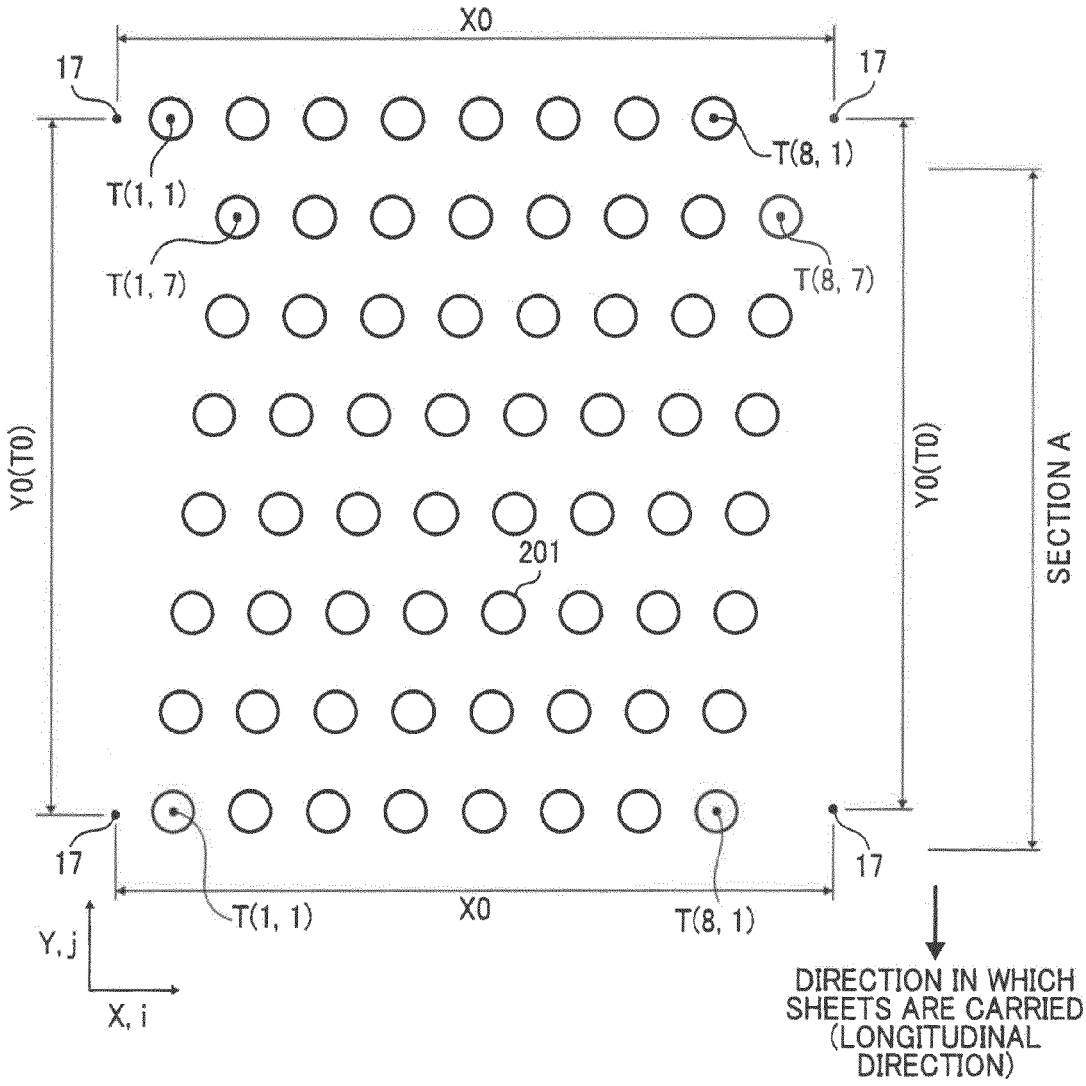
FIG. 12 is a plan view schematically illustrating an exemplary arrangement of through holes in the transport belt.
Figure 13:
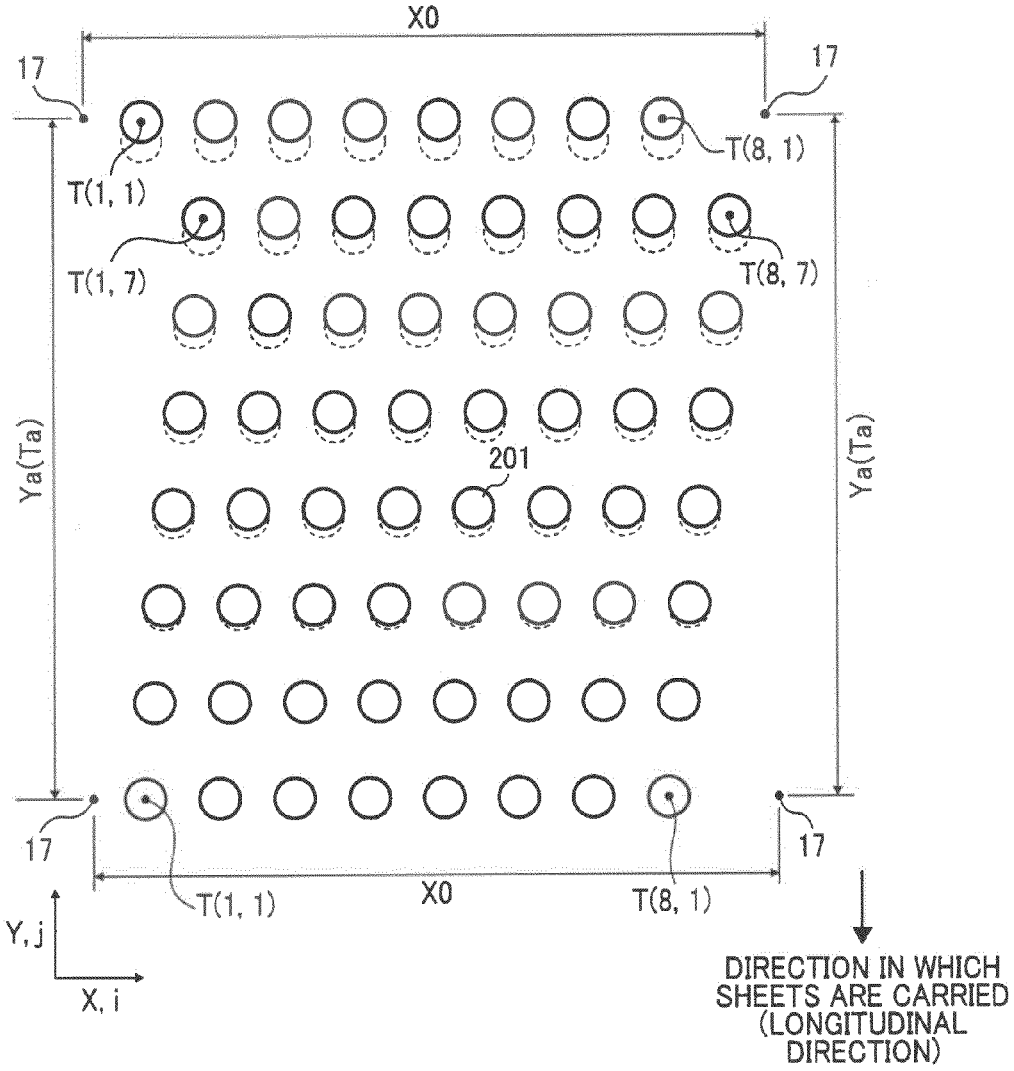
FIG. 13 is a plan view illustrating an exemplary arrangement of the through holes on the occurrence of deformation of the transport belt.
Figure 14:
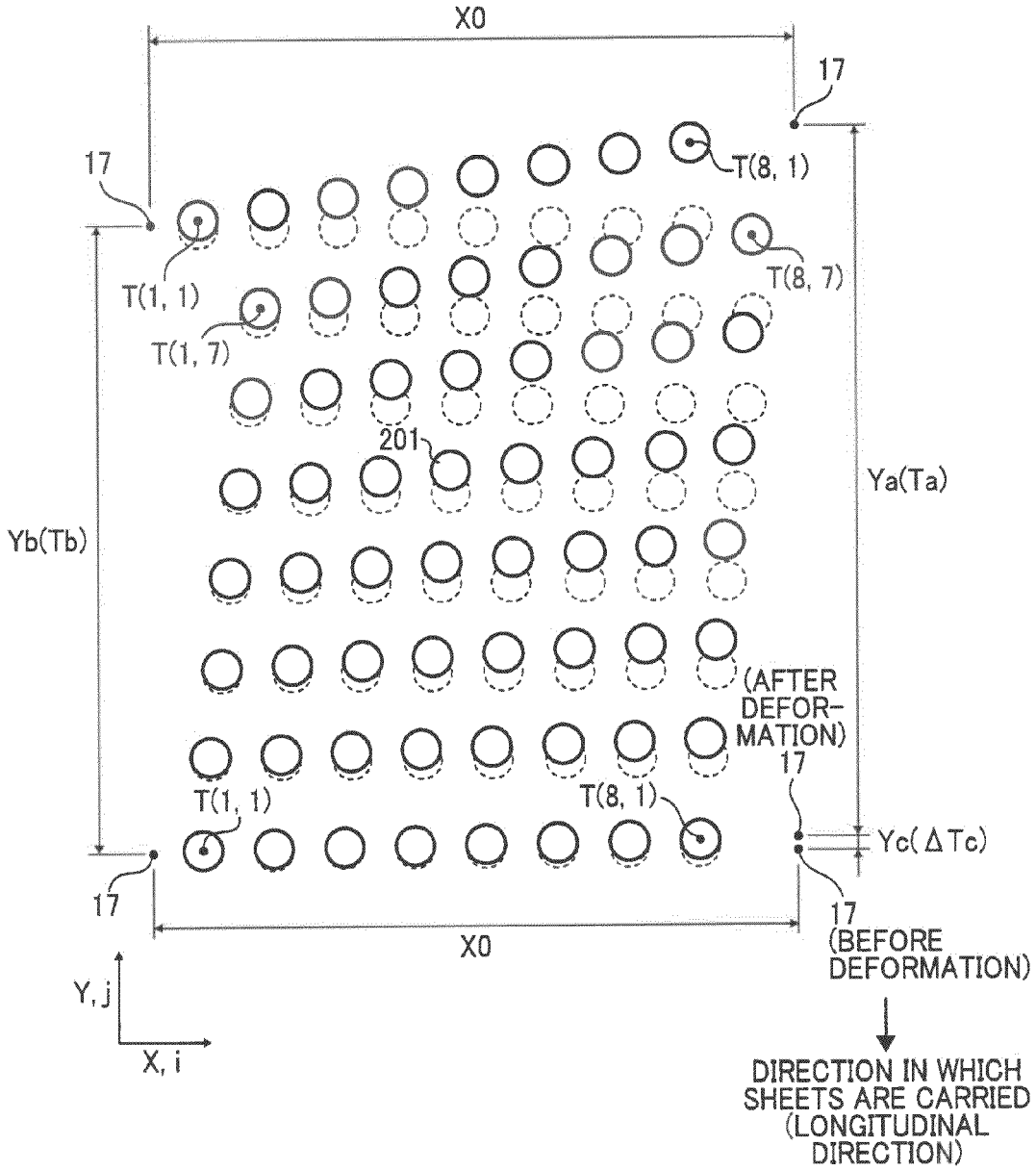
FIG. 14 is a plan view illustrating another exemplary arrangement of the through holes on the occurrence of deformation of the transport belt.

FIGS. 12 to 14 each show exemplary arrangements of the suction holes 201. More specifically, FIG. 12 shows an initial state in which no deformation is generated in the transport belt 43. FIG. 13 shows a case where the transport belt 43 stretches uniformly in the direction in which sheets are carried (in the direction in which the transport belt 43 circulates). FIG. 14 shows a case where stretch of the transport belt 43 in the direction in which sheets are carried differs between the opposite edges of the width direction of the transport belt 43. For the sake of convenience, the direction in which sheets are carried is called a Y direction (direction toward the upstream side thereof, namely toward each upper side of FIGS. 12 to 14 is called a +Y direction). A direction (width direction of the transport belt 43, namely scanning direction) perpendicular to the direction in which sheets are carried is called an X direction (direction toward one side of the width direction of the transport belt 43, more specifically toward each right side of FIGS. 12 to 14 is called a +X direction). Each of the suction holes 201 ranks $i^{th}$ (i is from one to eight) in the X direction, and ranks $j^{th}$ (j is from one to seven) in the Y direction. As is already described, the marks 17 are provided in corresponding relationship with a reference suction hole row (reference hole row), and on opposite sides of the width direction of the reference suction hole row. The positions of the suction holes 201 before the deformation are shown by dashed lines in FIGS. 13 and 14.

In the case of FIG. 13, a distance after deformation between the marks 17 in the direction in which the transport belt 43 circulates is increased to Ya from Y0 (Ya>Y0) that is a distance in the initial state before the deformation (FIG. 12). The way of stretch of the transport belt 43 is uniform in its width direction. Accordingly, the distance between the marks 17 is Ya at both opposite sides of the width direction. The distances Y0 and Ya are proportional to time differences T0 and Ta, respectively. Accordingly, the amount of correction of discharge timing for each of the suction holes 201 is determined by a ratio between the time differences T0 and Ta.

Timing Tinit(i, j) in the initial state shown in FIG. 12 is represented by the following formula using the left lower mark 17 in each of FIGS. 12 to 14 as a benchmark:

$$Tinit(i,j)=Ry(i,y)\times T0.$$

In this formula, Ry(i, j) is a ratio of a distance in the Y direction between the mark 17 that is the benchmark (left lower mark 17 shown in each of FIGS. 12 to 14) and the $(i, j)^{th}$ suction hole 201 to the distance Y0 in the Y direction between the mark 17 that is the benchmark and another mark 17 that is a next benchmark (left upper mark 17 shown in each of FIGS. 12 to 14) (0<Ry(i, j)<1). Ry(i, j) is a constant that can be geometrically obtained from the position of the corresponding suction hole 201, and is stored in a nonvolatile memory such as the hard disk 501*g* or the NV-RAM 501*e*. The time difference T0 in the initial state in which no deformation is generated in the transport belt 43 is also stored in a nonvolatile memory such as the hard disk 501*g* or the NV-RAM 501*e*.

When the transport belt 43 stretches and the way of stretch is uniform in every position of its width direction as shown in FIG. 13, a discharge timing shift ΔTa(i, j) at the $(i, j)^{th}$ suction hole 201 caused by a stretch (Ta−T0) is represented by the following formula:

$$\Delta Ta(i,j)=(Ta-T0)\times Ry(ij).$$

A discharge timing T(i, j) with respect to T(1, 1) is represented by the following formula:

$$T(i,j)=Tinit(i,j)+\Delta Ta(i,j).$$

In FIG. 14, the discharge timing shift ΔTa(i, j) at the $(i, j)^{th}$ suction hole 201 caused by the stretch (Ya−Y0, Ta−T0) of the transport belt 43 at the right side of FIG. 14 becomes greater in a direction toward the right side of FIG. 14, and is represented by the following formula:

$$\Delta Ta(i,j)=(Ta-T0)\times Rx(i,j)\times Ry(i,j).$$

In this formula, Rx(i, j) is a ratio of a distance in the X direction between the mark 17 that is the benchmark (left lower mark 17 in each of FIGS. 12 to 14) and the $(i, j)^{th}$ suction hole 201 to a distance X0 in the X direction between the mark 17 that is the benchmark and the mark 17 opposite thereto in the width direction of the transport belt 43 (right lower mark 17 in each of FIGS. 12 to 14) (0<Rx(i, j)<1). Rx(i, j) is a constant that can be geometrically obtained from the position of the corresponding suction hole 201, and is also stored in a nonvolatile memory such as the hard disk 501*g* or the NV-RAM 501*e*.

In FIG. 14, a discharge timing shift ΔTb(i, j) at the $(i, j)^{th}$ suction hole 201 caused by the stretch (Yb−Y0, Tb−T0) of the transport belt 43 at the left side of FIG. 14 becomes greater in a direction toward the left side of FIG. 14, and is represented by the following formula:

$$\Delta Tb(i,j)=(Tb-T0)\times((1-Rx(i,j))/1)\times Ry(i,j).$$

In the example of FIG. 14, an inclination Yc is generated that corresponds to difference in stretches in the direction in which the transport belt 43 circulates between the opposite sides of the width direction of the transport belt 43. A discharge timing shift ΔTc caused by the inclination Yc is detected as a difference between times at which the marks 17 on the opposite sides of the width direction of the transport belt 43 are detected. The discharge timing shift ΔTc(i, j) at the $(i, j)^{th}$ suction hole 201 caused by the inclination Yc is represented by the following formula:

$$\Delta Tc(i,j)=\Delta Tc\times Rx(i,j)\times Ry(i,j).$$

In summary, in the case of FIG. 14, a discharge timing shift ΔT(i, j) caused by the deformation is represented by the following formula:

$$\Delta T(i,j)=\Delta Ta(i,j)+\Delta Tb(i,j)+\Delta Tc(i,j).$$

Further, the discharge timing T(i, j) with respect to T(1, 1) is represented by the following formula:

$$T(i,j)=Tinit(i,j)+\Delta Ta(i,j)+\Delta Tb(i,j)+\Delta Tc(i,j).$$

The same calculation is applied when an inclination in the opposite direction is generated.

In this way, a discharge timing for the $(i, j)^{th}$ suction hole 201 is determined based on the results of detection obtained by the sensors 16. Accordingly, timings of discharge through nozzles are changed according to the condition of deformation of the transport belt 43. As a result, in the present embodiment, it is possible to precisely control ink droplets to pass through the through holes, which makes it possible to enhance efficiency of preliminary discharge. The aforementioned time difference and discharge timings are estimated values determined on the assumption that change in stretch of the transport belt 43 is linear to change in a position within a unit suction hole group (section A shown in FIG. 12). The aforementioned way to obtain estimated values is given merely as an example, and various modifications thereof are applicable.

It is preferable that the aforementioned results of detection (times), time difference, determined discharge timings, or the histories thereof be stored in a nonvolatile memory such as the hard disk 501*g* or the NV-RAM 501*e*. The reason therefor is as follows. The marks 17 on the opposite sides of the width direction of the transport belt 43 may not be related to each other when deformation (especially the aforementioned inclination) increases. This increases an error between determined discharge timings, which is avoided by the aforementioned storage in the nonvolatile memory.

As in the case of FIG. 13, when the rate of stretch of the transport belt 43 does not change in its width direction, or a shift (inclination) in the direction in which the transport belt 43 circulates and between the opposite sides of its width direction is not generated, the sensor 16 may be provided on one side of the width direction of the transport belt 43, and along the direction in which the transport belt 43 circulates (direction in which sheets are carried). This can reduce the number of sensors 16 to be provided, thereby simplifying the structure.

Turning back to FIG. 10, after determining time difference and discharge timings in the way described above, the CPU 501*a* becomes operative to function as the preliminary discharge control unit 511*d* to cause discharge of ink droplets through each of the nozzles 102 according to the determined amounts of correction and determined discharge timings (step S8). Correspondences between the nozzles 102 and the suction holes 201 are stored in a nonvolatile memory such as the hard disk 501*g* or the NV-RAM 501*e*. Accordingly, the CPU 501*a* can control timing of discharge through each of the nozzles 102 by referring to the correspondences.

In the present embodiment, it is determined that the transport belt 43 is in an abnormal state when a detected or calculated time difference is too large. In this case, a process different from that in a normal state is performed. More specifically, a maximum ΔTmax of the detected or determined time shift ΔT (such as Ta, Tb, Ta−T0 or Tb−T0) is compared with the relevant first and second thresholds Th1 and Th2 (in steps S4 and S5, Th1<Th2). When the maximum ΔTmax of the time shift ΔT is the same as or greater than both of the first and second thresholds Th1 and Th2 (namely, when results of steps S4 and S5 are both Yes), the CPU 501*a* becomes operative to function as the operation stop control unit 511*f*. Then, the CPU 501*a* stops at least part of the function (image forming function, for example) of the image forming device 1 (step S6). The reason therefor is that deformation of the transport belt 43 may exert influence upon a different function, thereby making it impossible to maintain quality at a desirable level. What is to be compared here may be a time difference (such as Ta and Tb) as a difference in detection time between the marks 17, or a time difference corresponding to the amount of deformation (such as Ta−T0 and Tb−T0). In the present embodiment, the time shift ΔT and its maximum ΔTmax correspond to a target value of comparison (parameter) used to determine an abnormality.

When the maximum ΔTmax of the time shift ΔT is the same as or greater than the first threshold Th1 but smaller than the second threshold Th2 (when the result of step S4 is Yes and the result of step S5 is No), the CPU 501*a* becomes operative to function as the abnormal time output control unit 511*e* to notify a user, a user support center or the like of the occurrence of an abnormality. More specifically, the abnormal time output control unit 511*e* may cause the operating unit 507 also having the function as a display unit to present an image (including a sentence) indicating the occurrence of the abnormality, or may transmit a notification signal through the communication interface 501*h* to a server in the user support center or a terminal (step S7). As a result, the user or the user support center is allowed to be notified of the abnormality on a more timely basis, thereby avoiding generation of a malfunction. After step S7, preliminary discharge control in step S8 is performed (step S8).

In the present embodiment, the first and second thresholds Th1 and Th2 are stored in a nonvolatile memory such as the hard disk 501*g* or the NV-RAM 501*e* as a threshold storage unit. Furthermore, the CPU 501*a* changes the first and second thresholds Th1 and Th2 in response to instructions to change the thresholds Th1 and Th2 based on an operation entered through the operating unit 507 or an operating unit of an external device (not shown). The transport belt 43 deteriorates with time at a speed that changes in response to the condition of use (frequency of use) or environment of use by the user. Accordingly, by variably setting the first and second thresholds Th1 and Th2, an abnormality is notified on a more timely basis to thereby avoid generation of a malfunction.

As described above, the present embodiment is provided with the preliminary discharge control unit 511*d* that controls timing of preliminary discharge of ink droplets through the nozzles 102 based on results of detecting the marks 17 as elements to be detected by the sensors 16. Thus, timing of discharge of ink droplets through each of the nozzles 102 can be controlled in consideration of deformation of the transport belt 43 such as a stretch, a contraction or an inclination based on the results of detecting the marks 17 formed on the transport belt 43. Accordingly, ink droplets are allowed to precisely pass through the suction holes 201 serving as through holes, which makes it possible to enhance efficiency of preliminary discharge. This control makes it possible to expand the range into which preliminary discharge is performed (preliminary discharge range) with respect to the size of the suction holes 201, so that the preliminary discharge can be completed in a shortened period of time. Thus, when preliminary discharge control is performed in an interval between sheets being carried during an image forming process, the interval between the sheets can be shortened to avoid reduction in speed of the image forming process to be caused by the preliminary discharge control.

In the present embodiment, the preliminary discharge control unit 511*d* delays timings of discharge of ink droplets through the nozzles 102 more largely with respect to their initial values as time difference determined by results of detection increases. That is, the condition of stretch or contraction of the transport belt 43 in its longitudinal direction is detected in a relatively easy way from time difference determined by the results of detection.

In the first embodiment, timing of preliminary discharge is controlled based on results of detecting the marks 17 arranged along the direction in which the transport belt 43 circulates. More specifically, shifts in position caused by the stretch or contraction of the transport belt 43 in the direction in which the transport belt 43 circulates can be taken into consideration based on results of detecting the marks 17 arranged along the direction in which the transport belt 43 circulates. Accordingly, ink droplets are allowed to more precisely pass through the suction holes 201 serving as through holes, which makes it possible to enhance efficiency of preliminary discharge to a greater degree.

In the present embodiment, timing of preliminary discharge is controlled based on results of detecting the marks 17 arranged along the width direction of the transport belt 43. More specifically, shifts in position caused by differences in degree of deformation of the transport belt 43 between the opposite sides of the width direction, or an inclination of the transport belt 43 can be taken into consideration based on the results of detecting the marks 17 arranged along the width direction. Accordingly, ink droplets are allowed to more precisely pass through the suction holes 201 serving as through holes, which makes it possible to enhance efficiency of preliminary discharge to a greater degree.

The present embodiment is provided with the abnormal time output control unit 511*e* that causes a predetermined output unit to produce an output indicative of the occurrence of an abnormality when a target value of comparison (in the present embodiment, time difference) determined by results of detecting the marks 17 are the same as or greater than the first threshold Th1. This allows a user or a user support center to recognize the occurrence of the abnormality in the transport belt 43, and to take necessary action.

The present embodiment is provided with the operation stop control unit 511*f* that stops at least part of the operation of the image forming device 1 when target value of comparison (in the present embodiment, time difference) determined by results of detecting the marks 17 are the same as or greater than the second threshold Th2 (provided that Th2>Th1). This avoids quality reduction in a different function such as an image forming function to be caused by deformation of the transport belt 43. Furthermore, an abnormality is notified to the user or the user support center based on the first threshold Th1 smaller than the second threshold Th2. This causes the user or the user support center to take action earlier to prevent development of the abnormality, thereby preventing a problem beforehand such as a malfunction.

The present embodiment is provided with a storage unit, such as the hard disk 501*g* and the NV-RAM 501*e*, composed of a nonvolatile storage device and serving to store therein the results of detecting the marks 17 or the time difference are stored. The reason therefor is as follows. The marks 17 on the opposite sides of the width direction of the transport belt 43 may not be related to each other when deformation (especially the aforementioned inclination) increases. This increases an error in determined discharge timings, which is avoided by the aforementioned provision of the storage unit. The provision of the storage unit also realizes more efficient control according to the condition of deformation of the transport belt 43. As an example of such a control, selection of nozzles 102 or timing correction may be not performed when the amount of deformation is relatively small, but be performed only when the amount of deformation is relatively large.

The present embodiment is provided with a threshold storage unit, such as the hard disk 501*g*, the NV-RAM 501*e*, composed of a nonvolatile storage device and serving to sore therein at least one of the first and second thresholds Th1 and Th2. The present embodiment is also provided with the operating unit 507 capable of changing at least one of the stored first and second thresholds Th1 and Th2. The transport belt 43 deteriorates with time at a speed that changes in response to the condition of use (frequency of use) or environment of use by a user. Accordingly, by variably setting at least one of the first and second thresholds Th1 and Th2, an abnormality is notified on a more timely basis to thereby avoid generation of a malfunction.

<Second Embodiment>

An image forming device according to a second embodiment will be described next by referring to FIGS. 15 to 22. The structure of an image forming device 1 according to the present embodiment is basically the same as that according to the first embodiment. Besides, in the present embodiment, nozzles 102 through which ink droplets are discharged into suction holes 201 serving as through holes are changed in response to deformation of a transport belt 43 in its width direction.

Deformation of the transport belt 43 in its width direction is determined based on results of detecting a pair of two marks 17 and 18 given from sensors 16. The pairs of marks 17 and 18 are arranged at opposite edges of the width direction of the transport belt 43, and at certain intervals in the longitudinal direction of the transport belt 43. In the present embodiment, nozzles 102 to be used for preliminary discharge are changed, and the change is controlled for each predetermined section of the transport belt 43. Accordingly, the pairs of marks 17 and 18 are arranged in corresponding relationship with the sections, preferably at boundaries between adjacent ones of the sections or at central portions of the sections, for example. The pairs of marks 17 and 18 at opposite edges of the width direction of the transport belt 43 are opposite to each other in this width direction. In the present embodiment, the marks 17 and 18 correspond to elements to be detected, and the sensors 16 correspond to detecting units.

The marks 18 are formed in a rectangular shape, and are each arranged in a position in which the longitudinal direction of the mark 18 is tilted relative to the longitudinal direction (direction in which sheets are carried and direction in which the transport belt 43 circulates), and to the width direction of the transport belt 43. In the present embodiment, the plurality of marks 18 are all tilted in the same direction at the same angle (45°) relative to the longitudinal direction of the transport belt 43. Like in the first embodiment, the marks 17 are formed in a rectangular shape, and are each arranged in a position in which the longitudinal direction of the mark 17 is the same as the width direction of the transport belt 43 (namely, perpendicular to the longitudinal direction of the transport belt 43 (direction in which sheets are carried)). The marks 17 are spaced from the marks 18 in the longitudinal direction of the transport belt 43, and in positions relatively close to the marks 18. In the present embodiment, the marks 17 are arranged on the downstream side of the direction in which sheets are carried with respect to the marks 18. Accordingly, the sensors 16 detect the marks 17 first, and detect the marks 18 thereafter.

Figure 15:
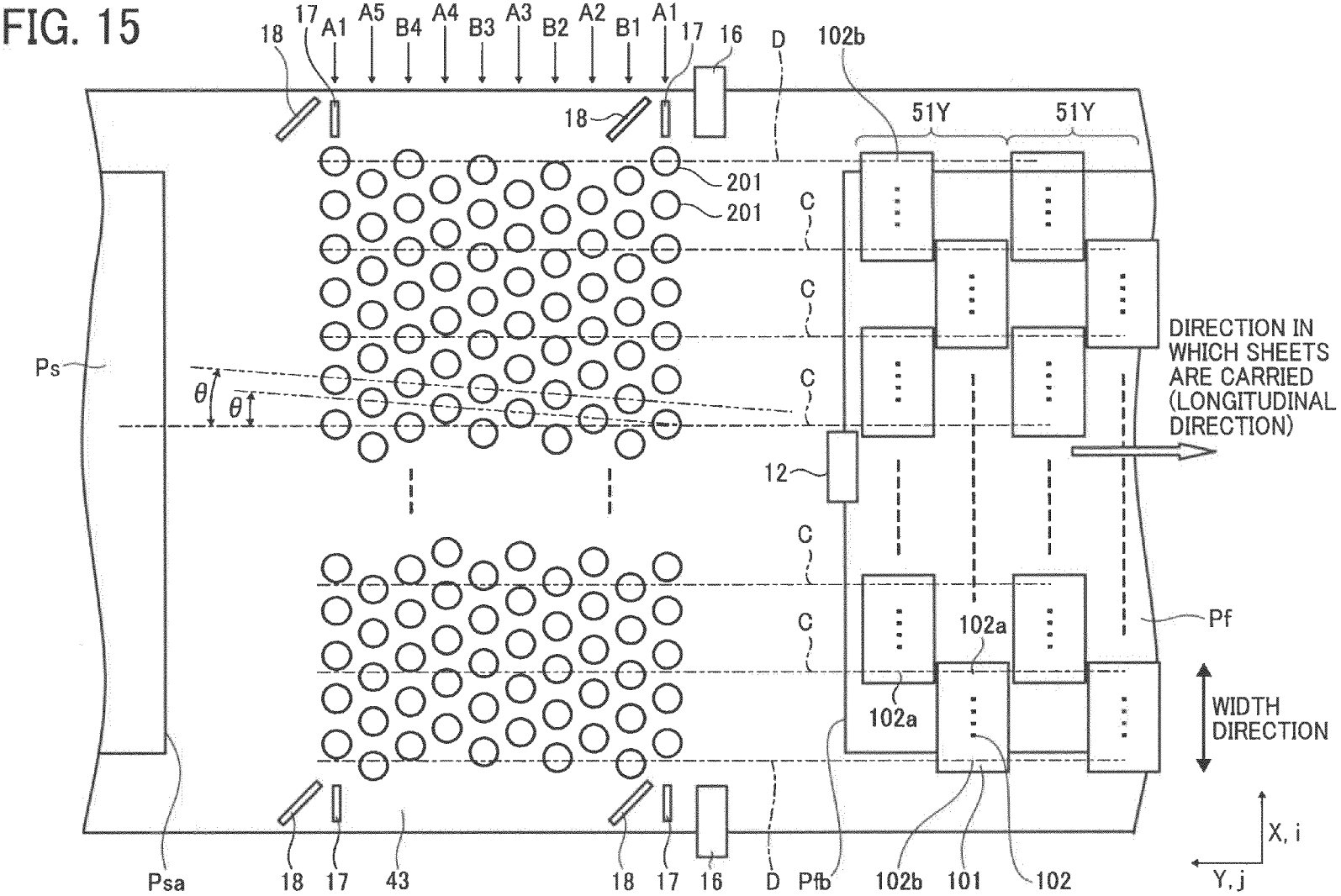
FIG. 15 is a plan view of a transport belt of an image forming device according to a second embodiment of the invention.
Figure 16:
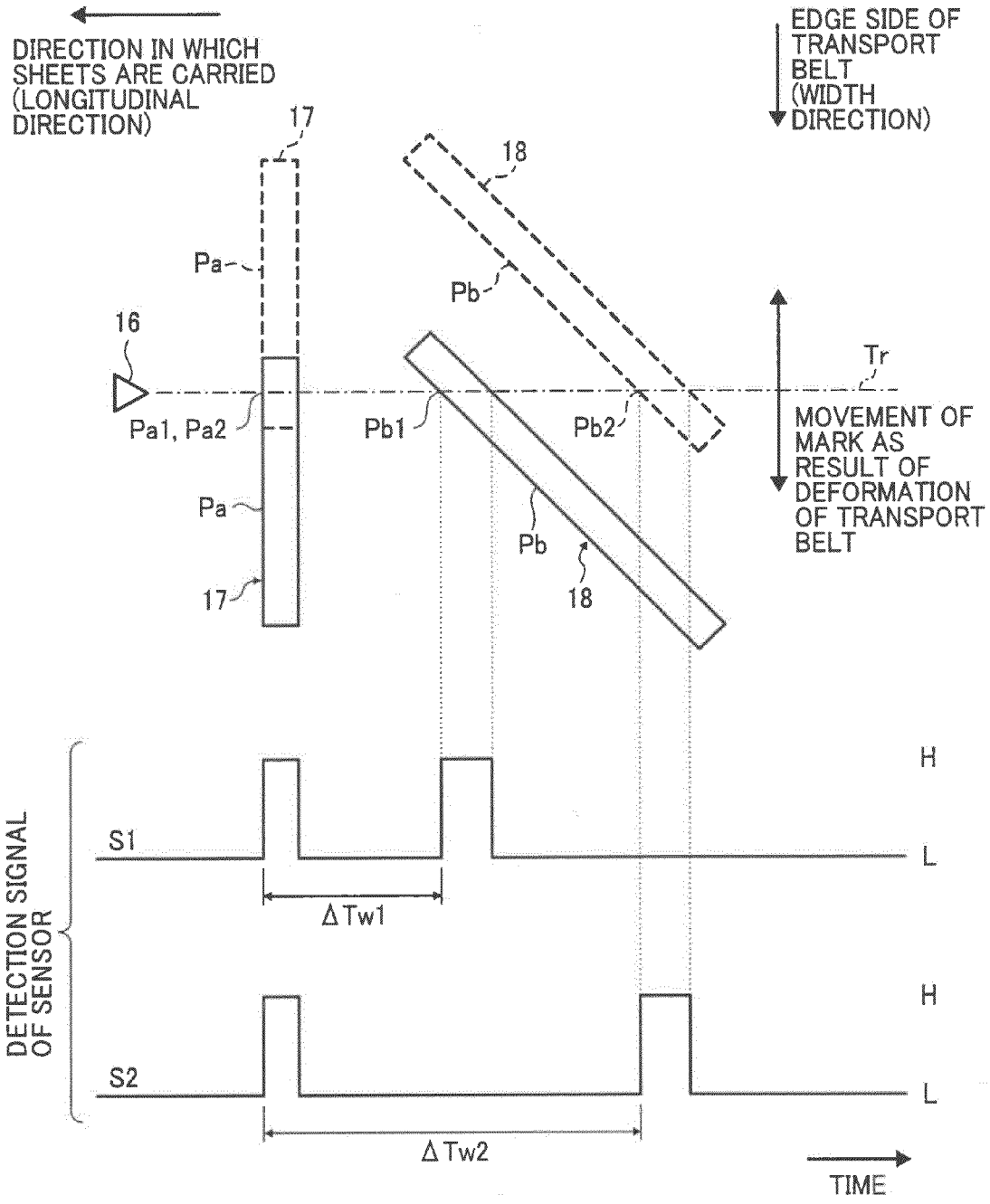
FIG. 16 is a schematic view illustrating an exemplary change of times at which elements to be detected are detected that is caused by deformation of the transport belt in its width direction.

The principles of detection of deformation of the transport belt 43 in its width direction by the marks 17 and 18 will be described below by referring to FIGS. 15 and 16. The direction in which sheets are carried is shown inversely between FIGS. 15 and 16. In the present embodiment, a distance in the longitudinal direction of the transport belt 43 between the marks 17 and 18 of one pair changes in the width direction of the transport belt 43. More specifically, the marks 18 are each arranged on the transport belt 43 in a position in which the mark 18 is detected later by the sensor 16 as the sensor 16 goes closer to one side of the width direction of the transport belt 43 (in the present embodiment, lower side of FIGS. 15 and 16). Furthermore, a distance in the longitudinal direction of the transport belt 43 between positions Pa and Pb in the front edge of one of the marks 17 and the front edge of a corresponding one of the marks 18, which are detected by the sensor 16, is set longer as the positions Pa and Pb go closer to one side of the width direction of the transport belt 43 (in the present embodiment, lower side of FIGS. 15 and 16). When the transport belt 43 stretches or contracts in its width direction, the position Pb of the mark 18 detected by the sensors 16 moves relatively in the width direction of the transport belt 43. As a result, a time at which the position Pb is detected by the sensors 16 is changed. It is assumed as an example that the transport belt 43 contracts so that an edge of the transport belt 43 in its width direction located at an upper side in FIGS. 15 and 16 (such an edge is shown only in FIG. 15) moves downward of FIGS. 15 and 16 from its initial position. In this case, the marks 17 and 18 relatively move downward with respect to the sensor 16 (orbit Tr thereof). Thus, the marks 17 and 18 are detected at positions Pa1 and Pb1, respectively. Accordingly, the mark 18 is detected at an earlier time, so that a time difference ΔTw1 between pulses as results of detecting the marks 17 and 18 decreases as seen from a detection signal S1 shown in FIG. 16. Conversely, it is assumed that the transport belt 43 stretches so that an edge of the transport belt 43 in its width direction located at an upper side in FIGS. 15 and 16 (such an edge is shown only in FIG. 15) moves upward of FIGS. 15 and 16 from its initial position. In this case, the marks 17 and 18 relatively move upward with respect to the sensor 16 (orbit Tr thereof). Thus, the marks 17 and 18 are detected at positions Pa2 and Pb2, respectively. Accordingly, the mark 18 is detected at a later time as seen from a detection signal S2 shown in FIG. 16, so that a time difference ΔTw2 between pulses as results of detecting the mark 17 and 18 increases. The marks 17 and 18 may be formed on the transport belt 43 such that the positions Pa and Pb, which are located at a center of the marks 17 and 18 in the width direction, are detected by the sensors 16, in an initial state, for example. However, this is merely an example. The initial positions of the marks 17 and 18 on the transport belt 43 in the width direction of the transport belt 43 (relative positions thereof with respect to the sensors 16) may suitably be defined according to the trend of deformation of the transport belt 43.

Accordingly, in the image forming device 1 according to the present embodiment, reduction in time difference ΔTw between times at which one of the marks 17 (front edge thereof) and a corresponding one of the marks 18 (front edge thereof) are detected by the sensors 16 results in the following: nozzles 102 selected as those to be used for preliminary discharge of ink droplets into each of the suction holes 201 having moved together with these marks 17 and 18 in the width direction of the transport belt 43 have longer distances from those of nozzles 102 used in an initial state toward the lower side of FIGS. 15 and 16. Conversely, increase in time difference ΔTw between times at which one of the marks 17 (front edge thereof) and a corresponding one of the marks 18 (front edge thereof) are detected by the sensors 16 results in the following: nozzles 102 selected as those to be used for preliminary discharge of ink droplets into each of the suction holes 201 having moved together with these marks 17 and 18 in the width direction of the transport belt 43 have longer distances from those of nozzles 102 used in the initial state toward the upper side of FIGS. 15 and 16. Thus, even when the transport belt 43 stretches or contracts in its width direction as a result of its deterioration caused, for example, by exhaustion, in response to resultant shifts in positions of the suction holes 201, nozzles 102 selected to be used for preliminary discharge are changed with a higher degree of precision. This avoids a problem such as discharge of ink droplets onto the transport belt 43. In the present embodiment, the marks 18 correspond to a first type of elements to be detected, and the marks 17 correspond to a second type of elements to be detected.

Figure 17:
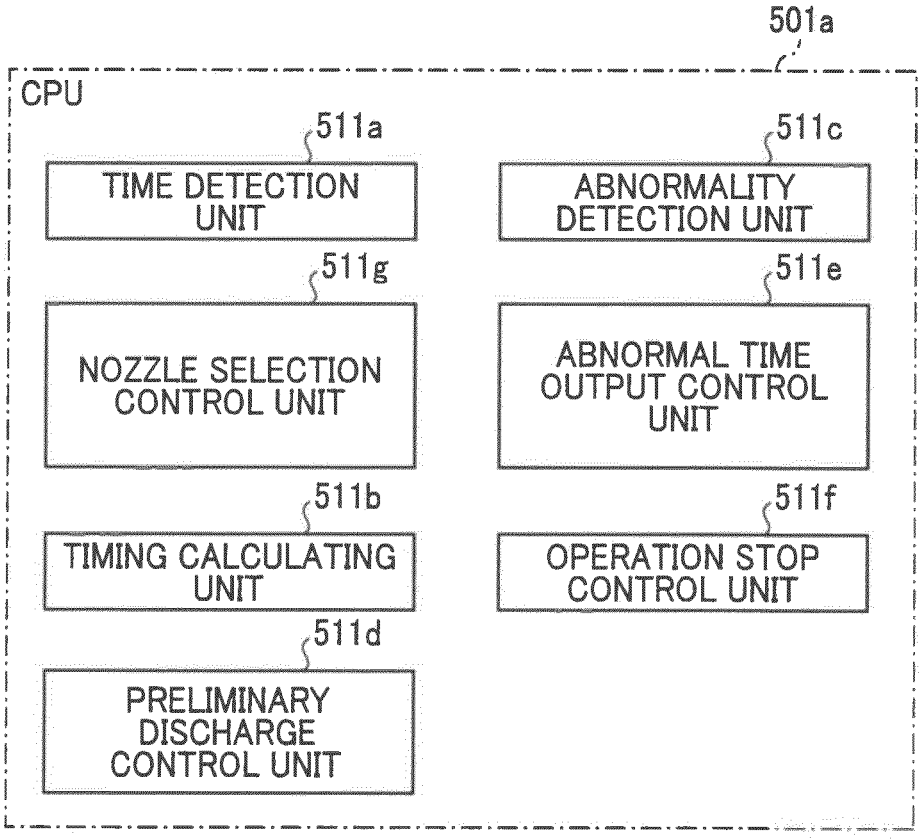
FIG. 17 is a block diagram illustrating a CPU.

In the present embodiment, in order to execute the control described above, a CPU 501*a* executes an application program stored in a RAM 501*c*. Then, as shown in FIG. 17, the CPU 501*a* becomes operative to function as a time detection unit 511*a*, a nozzle selection control unit 511*g*, a timing calculating unit 511*b*, an abnormality detection unit 511*c*, a preliminary discharge control unit 511*d*, an abnormal time output control unit 511*e*, and an operation stop control unit 511*f*. That is, a program for the main control unit 501 contains respective modules for causing the CPU 501*a* to function as the time detection unit 511*a*, the nozzle selection control unit 511*g*, the timing calculating unit 511*b*, the abnormality detection unit 511*c*, the preliminary discharge control unit 511*d*, the abnormal time output control unit 511*e*, and the operation stop control unit 511*f*.

The time detection unit 511*a* determines times at which the marks 17 and 18 are detected based on results of detecting the marks 17 and 18 given from the sensors 16.

Based on times determined by the time detection units 511*a* at which the marks 17 and 18 are detected, the nozzle selection control unit 511*g* calculates difference between the times at which the marks 17 and 18 are detected. Based on the calculated time difference, the nozzle selection control unit 511*g* selects nozzles 102 to be used for preliminary discharge into each of the suction holes 201. A specific way of selection will be described later.

Based on times determined by the time detection unit 511*a*, the timing calculating unit 511*b* calculates differences between the times at which the plurality of marks 17 are detected. Based on the calculated time differences, the timing calculating unit 511*b* determines timings (discharge timings) of preliminary discharge of ink droplets through the nozzles 102 selected by the nozzle selection control unit 511*g*. A specific way of determining times is the same as that of the first embodiment, and accordingly is not described again.

Like in the first embodiment, the abnormality detection unit 511*c* compares the difference between times at which the plurality of marks 17 are detected with the first and second thresholds Th1 and Th2 set in advance for this time difference. When this time difference is the same as or greater than the thresholds Th1 and Th2, the abnormality detection unit 511*c* determines that an abnormality is generated in the transport belt 43.

In the present embodiment, the abnormality detection unit 511*c* also compares difference between times at which one of the plurality of marks 17 and a corresponding one of the marks 18 are detected with the third and fourth thresholds Th3 and Th4 set in advance for this time difference. When this time difference is the same as or greater than the thresholds Th3 and Th4, the abnormality detection unit 511*c* determines that an abnormality is generated in the transport belt 43. That is, in the present embodiment, the abnormality detection unit 511*c* functions as a second abnormality detection unit.

The preliminary discharge control unit 511*d* causes discharge of ink droplets through nozzles 102 selected by the nozzle selection control unit 511*g*, at timings determined by the timing calculating unit 511*b* toward each of the suction holes 201. The abnormal time output control unit 511*e* and the operation stop control unit 511*f* function in the same ways as those of the corresponding ones of the first embodiment.

Figure 18:
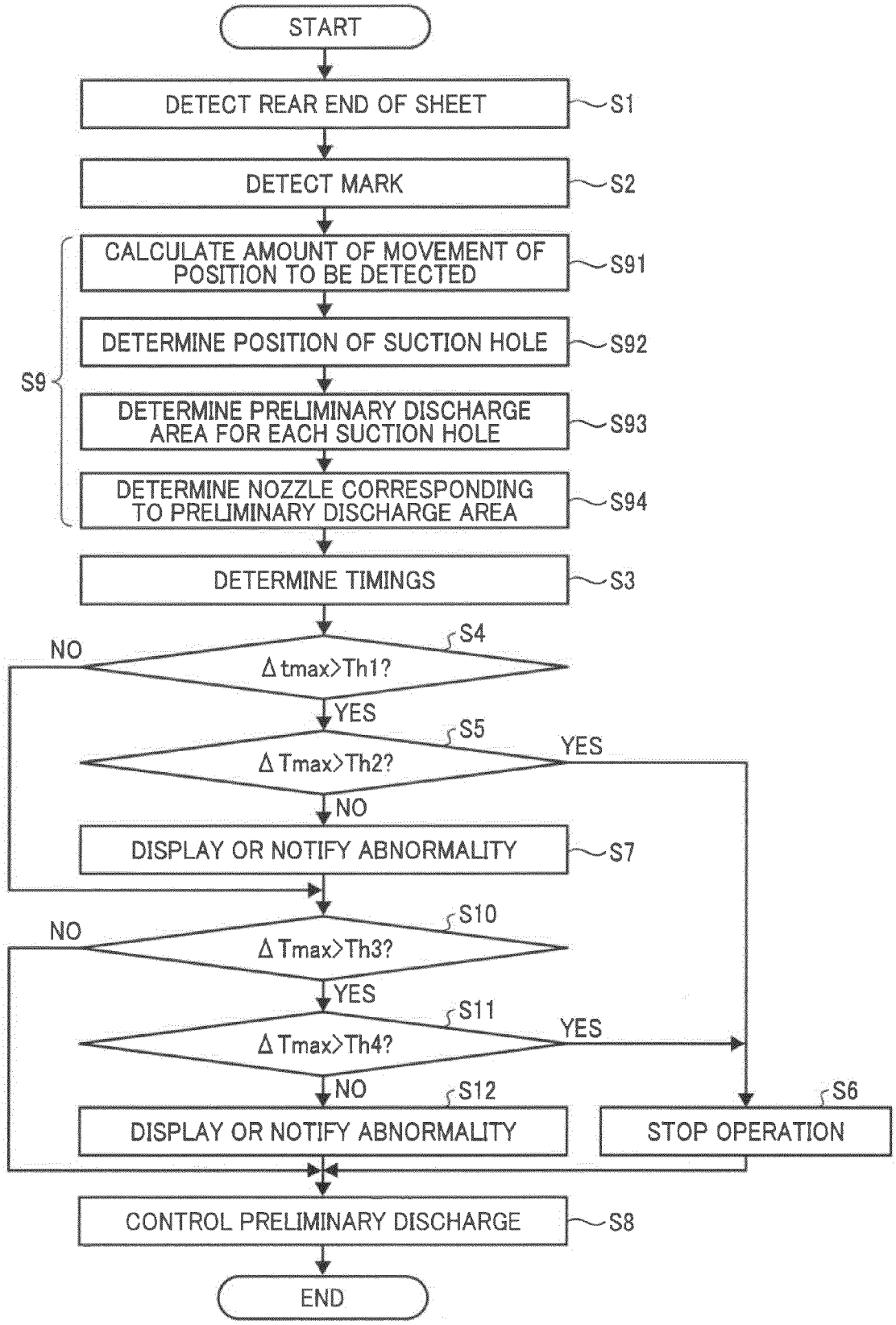
FIG. 18 is a flowchart illustrating an exemplary procedure of preliminary discharge.

Next, the process flow of preliminary discharge control in the image forming device 1 will be described by referring to FIG. 18. First, when the recording position detection unit 12 detects the rear end of a sheet P as described above (step S1), the CPU 501*a* becomes operative to function as the time detection unit 511*a* to detect the marks 17 and 18 as elements to be detected (step S2). The CPU 501*a* thereafter becomes operative to function as the nozzle selection control unit 511*g* to calculate difference between times at which the marks 17 and 18 are detected. Based on the calculated time difference, the CPU 510*a* selects nozzles 102 to be used for preliminary discharge into each of the suction holes 201 (step S9).

An exemplary way of selecting nozzles in step S9 will be described by referring to FIG. 15 and FIGS. 19 to 22. First, based on the results of detecting the marks 17 and 18, the nozzle selection control unit 511*g* calculates the amount of movement of a position (detected position), at which a pair of the marks 17 and 18 are arranged, in the width direction (X direction) of the transport belt 43 (step S91). In the present embodiment, as shown in FIG. 15, a greater difference between times at which the marks 17 and 18 are detected means that the transport belt 43 have moved further to the upper side of FIG. 15 with respect to the sensors 16 (namely, in a direction toward the right side in FIGS. 19 to 21 or in a +X direction). Conversely, a smaller difference between times at which the marks 17 and 18 are detected means that the transport belt 43 have moved further to the lower side of FIG. 15 with respect to the sensors 16 (namely, in a direction toward the left side in FIGS. 19 to 21 or in a −X direction). Accordingly, in step S91, the nozzle selection control unit 511*g* calculates the amount of movement of the pair of the marks 17 and 18 in the X direction by using a difference between times at which the marks 17 and 18 are detected by the sensors 16. This calculation is made based on a correlation of a difference between times at which the marks 17 and 18 are detected, and the amount of movement of the marks 17 and 18 in the X direction with respect to the sensors 16. An example of this correlation is shown in FIG. 22. This correlation may be stored, for example, as functions or as a map containing correspondences between inputs and outputs into a nonvolatile memory such as the hard disk 501*g* or the NV-RAM 501*e*.

Figure 19:
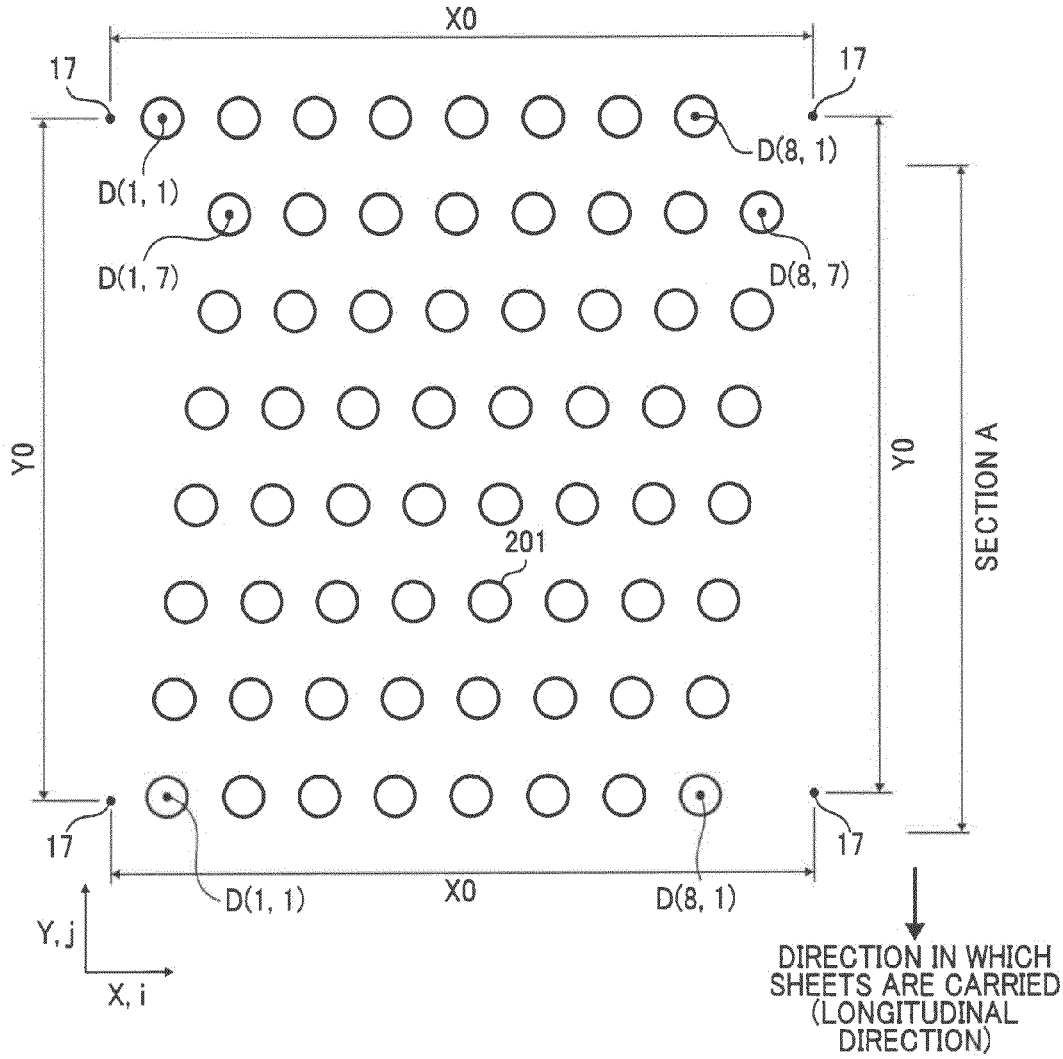
FIG. 19 is a plan view schematically illustrating an exemplary arrangement of through holes in the transport belt.
Figure 20:
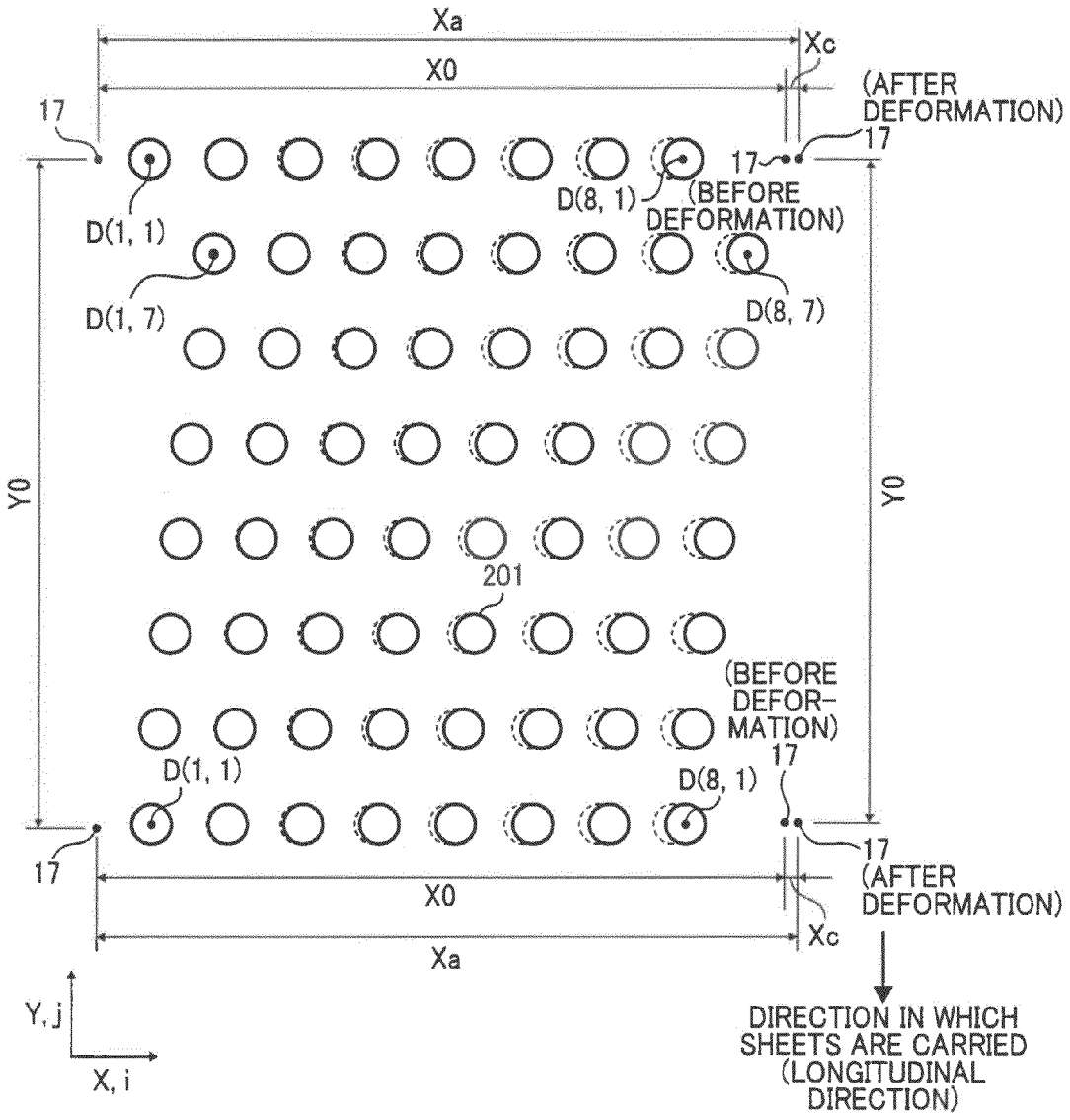
FIG. 20 is a plan view illustrating an exemplary arrangement of the through holes on the occurrence of deformation of the transport belt.
Figure 21:
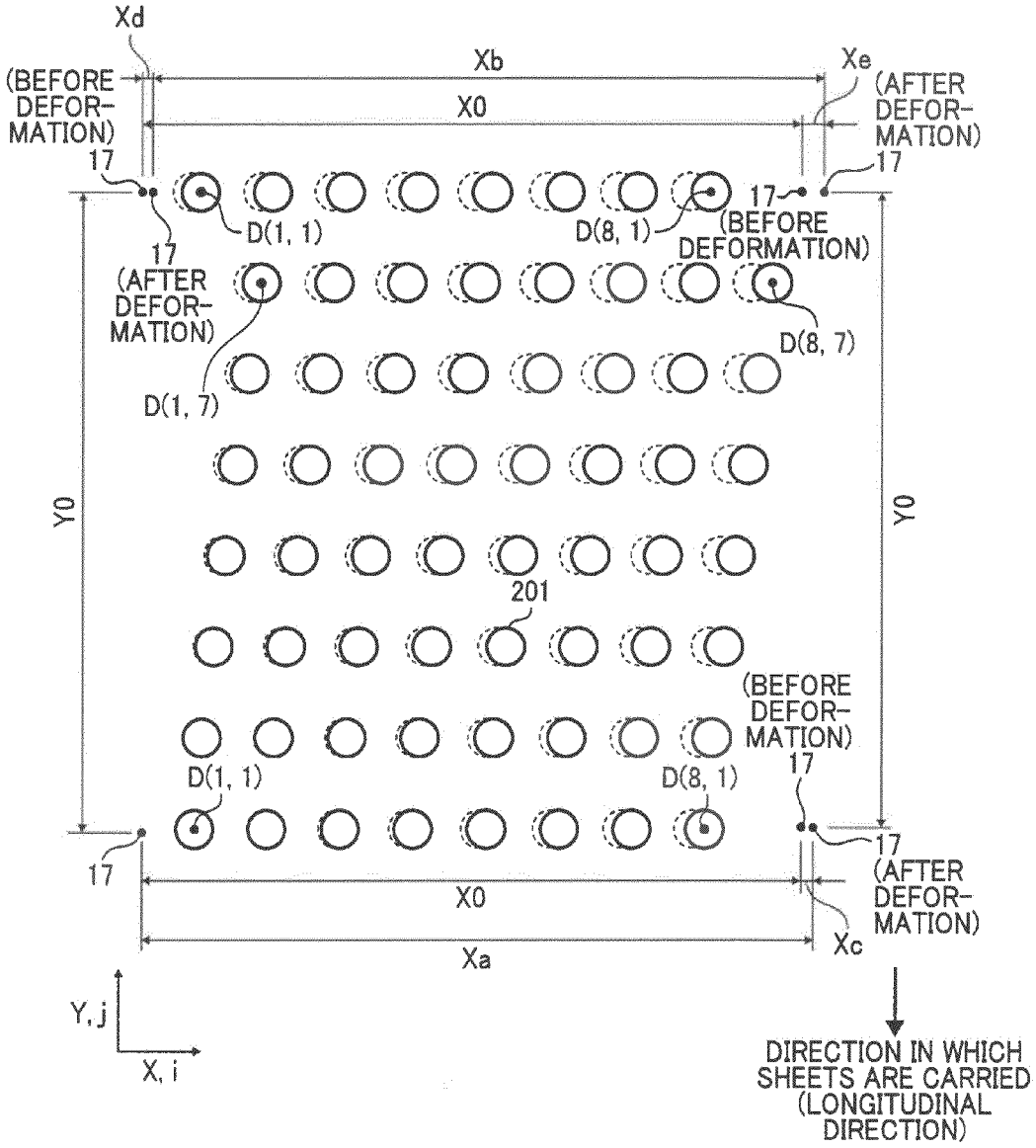
FIG. 21 is a plan view illustrating another exemplary arrangement of the through holes on the occurrence of deformation of the transport belt.
Figure 22:
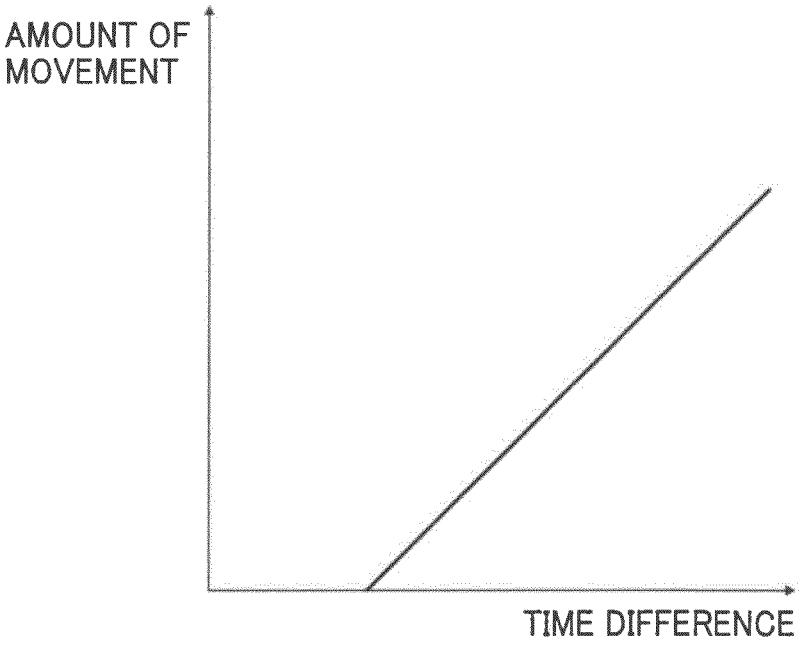
FIG. 22 is a graph showing an exemplary correlation of a difference between times at which marks of a pair are detected by a sensor, and the amount of shift of the marks of the pair in the width direction of the transport belt.

FIGS. 19 to 21 each show an exemplary arrangement of the suction holes 201. More specifically, FIG. 19 shows an initial state in which no deformation is generated in the transport belt 43. FIG. 20 shows a case where the transport belt 43 uniformly stretches in a direction perpendicular to the direction in which sheets are carried (namely, in its width direction of the transport belt 43). FIG. 21 shows a case where the transport belt 43 stretches in its width direction and the way of stretch differs in its longitudinal direction. For the sake of convenience, the direction in which sheets are carried is called a Y direction (direction toward the upstream side thereof, namely toward each upper side of FIGS. 19 to 21 is called a +Y direction). A direction (width direction of the transport belt 43, namely scanning direction) perpendicular to the direction in which sheets are carried is called an X direction (direction toward one side of the width direction of the transport belt 43, more specifically toward each right side of FIGS. 19 to 21 is called a +X direction). Each of the suction holes 201 ranks $i^{th}$ (i is from one to eight) in the X direction, and ranks $j^{th}$ (j is from one to seven) in the Y direction. Like in the first embodiment, the marks 17 are provided in corresponding relationship with a reference suction hole row (reference hole row), and on opposite sides of the width direction of the reference suction hole row. The positions of the suction holes 201 before deformation of the transport belt 43 are shown by dashed lines in FIGS. 20 and 21. Here, for the sake of convenience, the transport belt 43 is shown to stretch toward the right side of FIGS. 19 to 21.

In the case of FIG. 20, a distance after deformation between the plurality of marks 17 in the width direction of the transport belt 43 is increased to Xa from X0 (Xa>X0) that is a distance before the deformation (FIG. 19). The transport belt 43 stretches in its width direction and the way of stretch is uniform in its longitudinal direction. Accordingly, the distance between the marks 17 is Xa at both of the upper and lower sides of FIG. 20.

In the initial state shown in FIG. 19, a position Dinit(i, j) of each of the suction holes 201 (position of the center thereof, for example) in the width direction of the transport belt 43 is represented by the following formula using the left lower mark 17 in each of FIGS. 19 to 21 as a benchmark:

$$Dinit(i,j)=Rx(i,j)\times X0.$$

In this formula, Rx(i, j) is a ratio of a distance in the X direction between the mark 17 that is the benchmark (left lower mark 17 shown in each of FIGS. 19 to 21) and the $(i, j)^{th}$ suction hole 201 to a distance X0 (initial value) in the X direction between the mark 17 that is the benchmark and another mark 17 that is a next benchmark (right lower mark 17 shown in each of FIGS. 19 to 21) opposite thereto in the width direction of the transport belt 43 (0<Rx(i, j)<1). Rx(i, j) is a constant that can be geometrically obtained from the position of the corresponding suction hole 201, and is stored in a nonvolatile memory such as the hard disk 501*g* or the NV-RAM 501*e*. The distance (initial value) X0 in the initial state in which no deformation is generated in the transport belt 43 is also stored in a nonvolatile memory such as the hard disk 501*g* or the NV-RAM 501*e*.

When the transport belt 43 stretches in its width direction and the way of stretch is uniform in every position of its longitudinal direction as shown in FIG. 20, a position shift ΔDa(i, j) of the $(i, j)^{th}$ suction hole 201 in this width direction caused by the stretch (Xa−X0=Xc) is represented by the following formula:

$$\Delta Da(i,j)=Xc\times Rx(ij).$$

Accordingly, a position (center position) D(i, j) of the suction hole 201 in the width direction of the transport belt 43 with respect to the left lower mark 17 in each of FIGS. 19 to 21 that is the benchmark is represented by the following formula:

$$D(i,j)=Dinit(i,j)+\Delta Da(i,j).$$

In FIG. 21, the position shift ΔDa(i, j) of the $(i, j)^{th}$ suction hole 201 in the width direction of the transport belt 43 caused by the stretch (Xb−X0=Xe−Xd) of the transport belt 43 in its width direction between the upper marks 17 of FIG. 21 becomes greater in a direction toward the upper side of FIG. 21, and thus is represented by the following formula:

$$\Delta Da(i,j)=(Xe-Xd)\times Ry(i,j)\times Rx(i,j).$$

In this formula, Ry(i, j) is a ratio of a distance in the Y direction between the mark 17 that is the benchmark (left lower mark 17 in each of FIGS. 19 to 21) and the $(i, j)^{th}$ suction hole 201 to a distance Y0 in the Y direction between the mark 17 that is the benchmark (left lower mark 17 in each of FIGS. 19 to 21) and another mark 17 that is the next benchmark (left upper mark 17 in each of FIGS. 19 to 21) adjacent to each other in the longitudinal direction of the transport belt 43 (0<Ry(i, j)<1). Ry(i, j) is a constant that can be geometrically obtained from the position of the corresponding suction hole 201, and is also stored in a nonvolatile memory such as the hard disk 501*g* or the NV-RAM 501*e*.

In FIG. 21, a position shift ΔDb(i, j) of the $(i, j)^{th}$ suction hole 201 in the width direction of the transport belt 43 caused by the stretch (Xa−X0=Xc) of the transport belt 43 in its width direction between the lower marks 17 of FIG. 21 becomes greater in a direction toward the lower side of FIG. 21, and thus is represented by the following formula:

$$\Delta Db(i,j)=Xc\times((1-Ry(i,j))/1)\times Rx(i,j).$$

In the example of FIG. 21, an inclination Xd is generated that corresponds to a difference in shifts in the width direction of the transport belt 43 between positions in the longitudinal direction of the transport belt 43. A position shift ΔDc caused by the inclination Xd is obtained by the amounts of movement of a plurality of pairs of marks 17 and 18 that are placed in their respective positions in the longitudinal direction of the transport belt 43. The position shift ΔDc(i, j) at the $(i, j)^{th}$ suction hole 201 caused by the inclination Xd is represented by the following formula:

$$\Delta Dc(i,j)=Xd\times Ry(i,j)\times Rx(i,j).$$

In summary, in the case of FIG. 21, a position shift ΔD(i, j) at the $(i, j)^{th}$ suction hole 201 caused by deformation of the transport belt 43 in its width direction is represented by the following formula:

$$\Delta D(i,j)=\Delta Da(i,j)+\Delta Db(i,j)+\Delta Dc(i,j).$$

Furthermore, the position D(i, j) of the suction hole 201 in the width direction of the transport belt 43 with respect to the mark 17 that is the benchmark is represented by the following formula:

$$D(i,j)=Dinit(i,j)+\Delta Da(i,j)+\Delta Db(i,j)+\Delta Dc(i,j).$$

The same calculation is applied when an inclination in the opposite direction is generated.

Turning back to FIG. 18, based on the results of detecting the marks 17 and 18 given from the sensors 16, the nozzle selection control unit 511*g* obtains the position shift ΔD and the position D(i, j) of the $(i, j)^{th}$ suction hole 201 (step S92). Next, based on the position D(i, j) of each of the suction holes 201 and a preliminary discharge length (length of preliminary discharge range) in the X direction in each of the suction holes 201, the nozzle selection control unit 511*g* determines a preliminary discharge section (range in the X direction) for each of the suction holes 201 (step S93). Then, the nozzle selection control unit 511*g* refers to the position of each of the nozzles 102 in the X direction to determine which nozzles 102 are to pass over the preliminary discharge section (step S94), thereby determining the nozzles 102 to be used for preliminary discharge into each of the suction holes 201 (step S9). The preliminary discharge length and the position of each of the nozzles 102 in the X direction are stored in a nonvolatile memory such as the hard disk 501*g* or the NV-RAM 501*e*.

In the present embodiment, nozzles 102 to be used for preliminary discharge into each of the suction holes 201 serving as through holes are selected according to the condition of deformation of the transport belt 43. As a result, ink droplets precisely pass through the through holes, which makes it possible to enhance efficiency of preliminary discharge. The aforementioned amounts of movement and the positions of the nozzles 102 are estimated values determined on the assumption that change in stretch of the transport belt 43 is linear to change in a position. The aforementioned way to obtain estimated values is given merely as an example, and various modifications thereof are applicable.

Next, the CPU 501*a* becomes operative to function as the timing calculating unit 511*b* to calculate difference between times at which the plurality of marks 17 are detected. Based on the calculated time difference, the CPU 510*a* determines timings (discharge timings) of preliminary discharge of ink droplets through the nozzles 102 (step S3). The process in step S3 is the same as that of the first embodiment, and is not described again accordingly. In the present embodiment, the marks 17 functioning as references for the marks 18 as the first type of elements to be detected are used to control timing of preliminary discharge through the nozzles 102. This advantageously results in a simple structure as compared to the case where marks used to control timing of preliminary discharge are formed separately from the references for the first type of elements to be detected.

It is preferable that the aforementioned results of detection (timings), parameters (target values of comparison in a later step) such as position shift and time difference determined based on the results of detection, or the histories thereof be stored in a nonvolatile memory such as the hard disk 501*g* or the NV-RAM 501*e*.

After steps S9 and S3, when it is determined from the results of detection that the amount of deformation of the transport belt 43 falls within an allowable range (normal state) (when results of steps S4 and S10 are both No), the CPU 501*a* becomes operative to function as the preliminary discharge control unit 511*d*. Then, the CPU 501*a* causes discharge of ink droplets (step S8) according to the amount of correction and discharge timings determined in step S3 through the nozzles 102 selected in step S9 to the respective suction holes 201.

When it is considered from the results of detection that the amount of deformation of the transport belt 43 in its width direction or in its longitudinal direction is out of the allowable range (abnormal state), a process different from that in the normal state is performed. More specifically, like in the first embodiment, a maximum ΔTmax of the time shift ΔT determined in step S3 is compared with the thresholds Th1 and Th2 in steps S4 and S5, respectively. Thereafter step S6 or S7 is performed. The processes in steps S6 and S7 are the same as those of the first embodiment (FIG. 10), and are not described accordingly. The determinations in steps S4 and S5, and the subsequent processes in steps S6 and S7 are intended to cope with the case where the transport belt 43 is deformed to an excessive extent in its longitudinal direction.

In addition to the above, in the present embodiment, the determinations in steps S10 and S11, and the subsequent processes in steps S6 and S12 are intended to cope with the case where the transport belt 43 is deformed to an excessive extent in its width direction. More specifically, a maximum ΔDmax of the position shift ΔD determined in step S9 (namely, a maximum of the position shift ΔD such as Xc, Xd or Xe of each pair of marks 17 and 18) is compared with the relevant third and fourth thresholds Th3 and Th4 (in steps S10 and S11, Th3<Th4). When the maximum ΔDmax of the position shift ΔD is the same as or greater than both of the third and fourth thresholds Th3 and Th4 (namely, when results of steps S10 and S11 are both Yes), the CPU 501*a* becomes operative to function as the operation stop control unit 511*f*. Then, the CPU 501*a* stops at least part of the function (image forming function, for example) of the image forming device 1 (step S6). The reason therefor is that deformation of the transport belt 43 may exert influence upon a different function, thereby making it impossible to maintain quality at a desirable level.

When the maximum ΔDmax of the position shift ΔD is the same as or greater than the third threshold Th3 but smaller than the fourth threshold Th4 (when the result of step S10 is Yes and the result of step S11 is No), the CPU 501*a* becomes operative to function as the abnormal time output control unit 511*e* to notify a user, a user support center and the like of the occurrence of an abnormality. More specifically, the abnormal time output control unit 511*e* causes the operating unit 507 also having the function as a display unit to present an image (including a sentence) indicating the occurrence of the abnormality. Or, the abnormal time output control unit 511*e* transmits a notification signal through the communication interface 501*h* to a server in the user support center or a terminal (step S12). As a result, the user or the user support center is allowed to be notified of the abnormality earlier, thereby avoiding generation of a malfunction. After step S12, preliminary discharge control is performed in step S8.

In the present embodiment, the third and fourth thresholds Th3 and Th4 are stored in a nonvolatile memory such as the hard disk 501*g* or the NV-RAM 501*e* as a threshold storage unit. Furthermore, the CPU 501*a* changes the third and fourth thresholds Th3 and Th4 in response to instructions to change the thresholds Th3 and Th4 based on an operation entered through the operating unit 507 or an operating unit of an external device (not shown). The transport belt 43 deteriorates with time at a speed that changes in response to the condition of use (frequency of use) or environment of use by the user. Accordingly, by variably setting the third and fourth thresholds Th3 and Th4, an abnormality is notified on a more timely basis to thereby avoid generation of a malfunction.

As described above, the present embodiment is provided with the marks 18 serving as the first type of elements to be detected, whose detected position in the width direction of the transport belt 43 changes in the longitudinal direction of the transport belt 43. The present embodiment is also provided with the nozzle selection control unit 511*g* that selects nozzles 102 to be used for preliminary discharge into each of the suction holes 201 serving as through holes based on results of detecting the marks 18 given from the sensors 16. Thus, nozzles 102 to be used for discharge of ink droplets into each of the suction holes 201 can be selected in consideration of deformation of the transport belt 43 such as a stretch, a contraction or an inclination based on the results of detecting the marks 18 formed on the transport belt 43. Accordingly, ink droplets are allowed to precisely pass through the suction holes 201 serving as through holes, which makes it possible to enhance efficiency of preliminary discharge. This control makes it possible to expand the preliminary discharge range with respect to the size of the suction holes 201, so that the preliminary discharge can be completed in a shortened period of time. Thus, when preliminary discharge control is performed in an interval between sheets being carried during an image forming process, the interval between the sheets can be shortened to avoid reduction in speed of the image forming process to be caused by the preliminary discharge control.

In the present embodiment, the marks 18 are each arranged on the transport belt 43 in a position in which the mark 18 is detected later by the sensors 16 as the mark 18 goes closer to one side of the width direction of the transport belt 43. Further, a later time of detection of each of the marks 18 by the sensors 16 results in the following: the nozzle selection control unit 511*g* selects nozzles 102 as those to be used for discharge of ink droplets into each of the suction holes 201 that have longer distances from those of nozzles 102 used in the initial state toward another side of the width direction of the transport belt 43. That is, the direction in which the marks 18 and the suction holes 201 move relative to the sensors 16 can be determined based on the results of detecting the marks 18. Further, more suitable nozzles 102 can be selected in response to the amounts of movement of the marks 18. Accordingly, ink droplets are allowed to more precisely pass through the suction holes 201 serving as through holes, which makes it possible to enhance efficiency of preliminary discharge to a greater degree. The nozzle selection control unit 511*g* controls timing of preliminary discharge for each of the nozzles 102, and this control includes the case where no droplets are to be discharged from the nozzles 102.

In the present embodiment, a distance in the longitudinal direction of the transport belt 43 between respective detected positions of the marks 18 and 17 is set longer as these positions go closer to one side of the width direction of the transport belt 43. Furthermore, a greater difference between times at which one of the marks 18 and a corresponding one of the marks 17 are detected by the sensor 16 results in the following: the nozzle selection control unit 511*g* selects nozzles 102 as those to be used for discharge of ink droplets into each of the suction holes 201 that have longer distances from those of nozzles 102 used in the initial state toward another side of the width direction of the transport belt 43. That is, based on a difference between a time at which one of the marks 18 as the first type of elements to be detected is detected and a time at which a corresponding one of the marks 17 as a reference for the one of the marks 18 is detected, the amounts of movement of the marks 18 are detected with a higher degree of precision to select more suitable nozzles 102. Accordingly, ink droplets are allowed to more precisely pass through the suction holes 201 serving as through holes, which makes it possible to enhance efficiency of preliminary discharge to a greater degree.

The present embodiment is provided with the abnormal time output control unit 511*e*, which causes a predetermined output unit to produce an output indicative of the occurrence of an abnormality when target value of comparison (in the present embodiment, position shift) determined by results of detecting the marks 18 as the first type of elements to be detected are the same as or greater than the third threshold Th3. This allows a user or a user support center to recognize the occurrence of the abnormality in the transport belt 43, and to take necessary action.

The present embodiment is provided with the operation stop control unit 511*f* that stops at least part of the operation of the image forming device 1 when target value of comparison (in the present embodiment, position shift) determined by results of detecting the marks 18 are the same as or greater than the fourth threshold Th4. This avoids quality reduction of a different function such as an image forming function caused by deformation of the transport belt 43. Furthermore, an abnormality is notified to the user or the user support center based on the third threshold Th3 smaller than the fourth threshold Th4. This causes the user or the user support center to take action earlier to prevent development of the abnormality, thereby preventing a problem beforehand such as a malfunction.

The present embodiment is provided with the hard disk 501*g* and the NV-RAM 501*e*, to serve as a storage unit composed of a nonvolatile storage device in which target value of comparison (in the second embodiment, position shift) based on results of detecting the marks 18 are stored. This realizes efficient control according to the condition of deformation of the transport belt 43. As an example of the control, selection of nozzles 102 or timing correction is not performed when the amount of deformation is relatively small, but is performed only when it is relatively large.

The present embodiment is provided with the hard disk 501*g* and the NV-RAM 501*e*, to serve as a threshold storage unit composed of a nonvolatile storage device in which at least one of the third and fourth thresholds Th3 and Th4 is stored. The present embodiment is also provided with the operating unit 507 capable of changing at least one of the stored third and fourth thresholds Th3 and Th4. The transport belt 43 deteriorates with time at a speed that changes in response to the condition of use (frequency of use) or environment of use by a user. Accordingly, by variably setting at least one of the third and fourth thresholds Th3 and Th4, an abnormality is notified on a more timely basis to thereby avoid generation of a malfunction.

Figure 23:
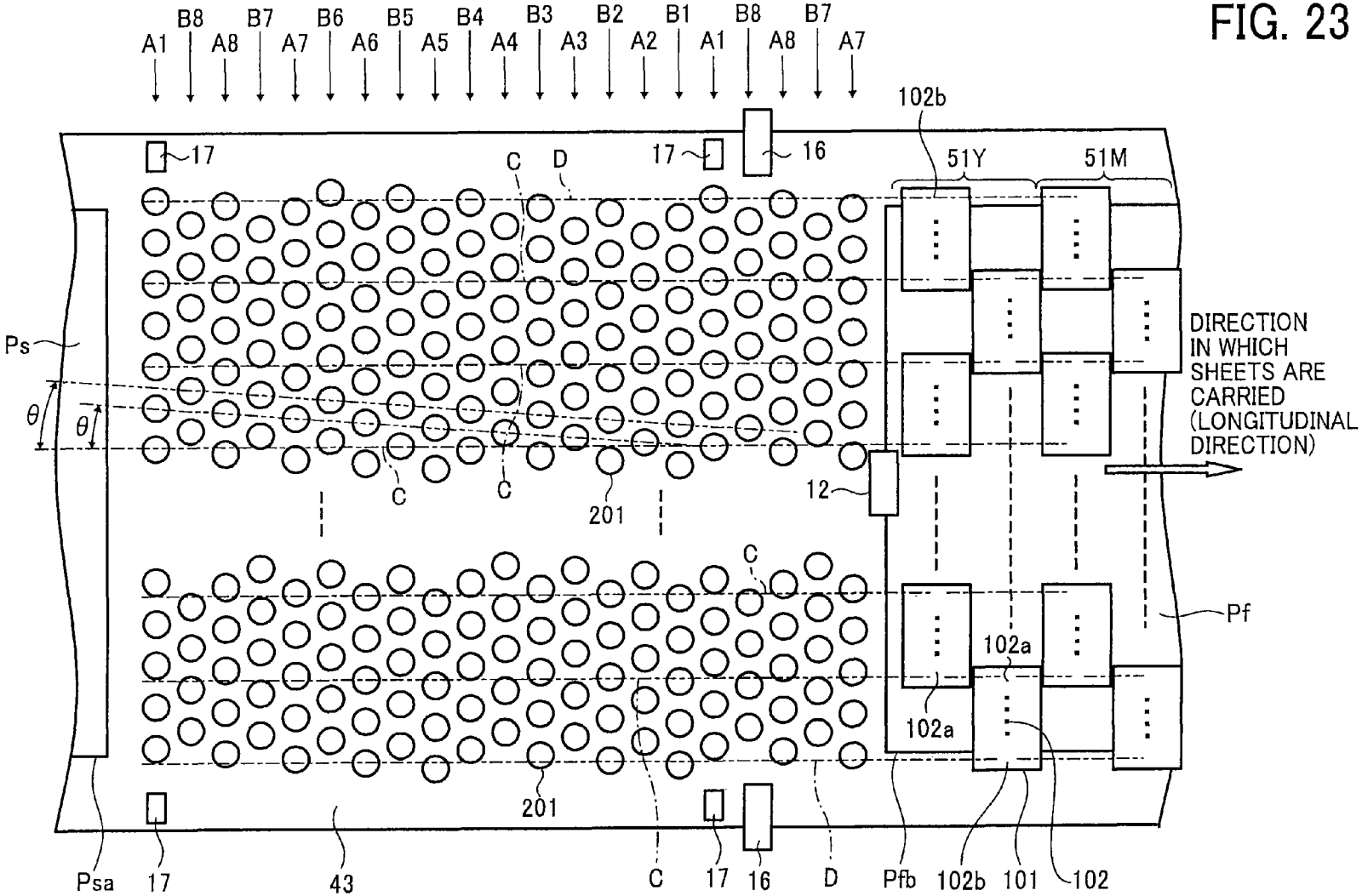
FIG. 23 is a plan view of another example of a transport belt in which through holes are formed.

While the preferred embodiments of the present invention have been described above, the invention is not limited to the above-described embodiments, but various modifications thereof is possible. As an example, the arrangement of suction holes serving as through holes is not limited to those shown in the above-described embodiments. Other settings such as arrangement of marks and formation of a coordinate system may suitably be changed. For example, the invention is also applicable to an image forming device as shown in FIG. 23. In this image forming device, the transport belt 43 is given suction holes (through holes) 201 continuously defined in the direction in which the transport belt 43 circulates. In the embodiments described above, based on four marks, nozzles are selected and discharge timings are determined for through holes in a region delimited by these marks. However, the number of marks may be greater or smaller. Furthermore, target value of comparison (parameters) to be compared with threshold are not limited to those shown in the embodiments described above, as long as they are applicable in making a determination as to the degree of deformation.

Figure 24A:
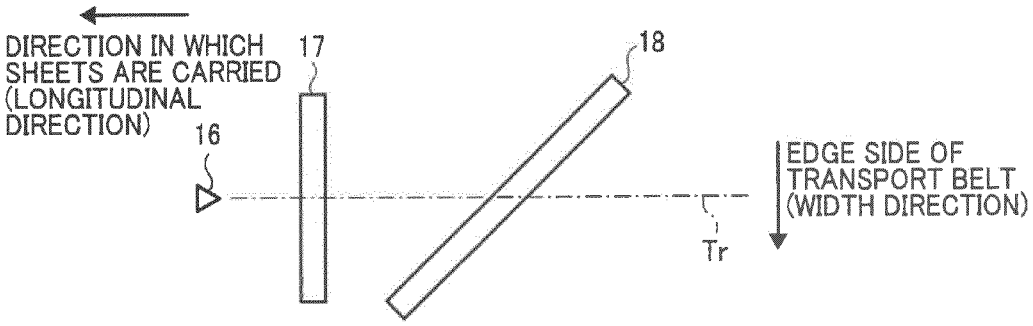
FIGS. 24A to 24C are views each illustrating a modification of a first type of element to be detected.
Figure 24B:
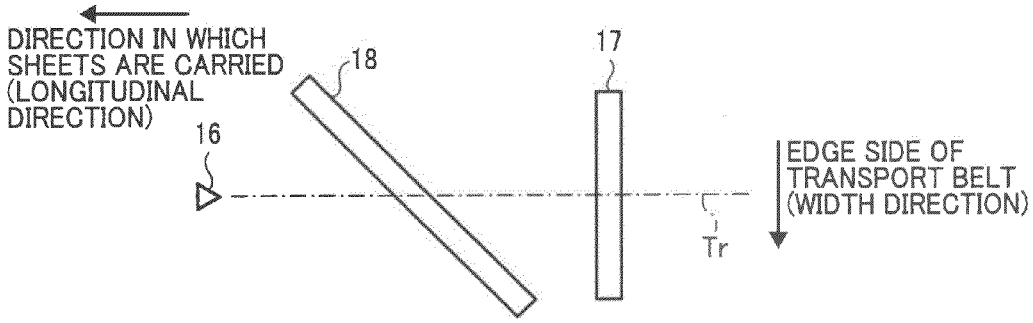
Figure 24C:
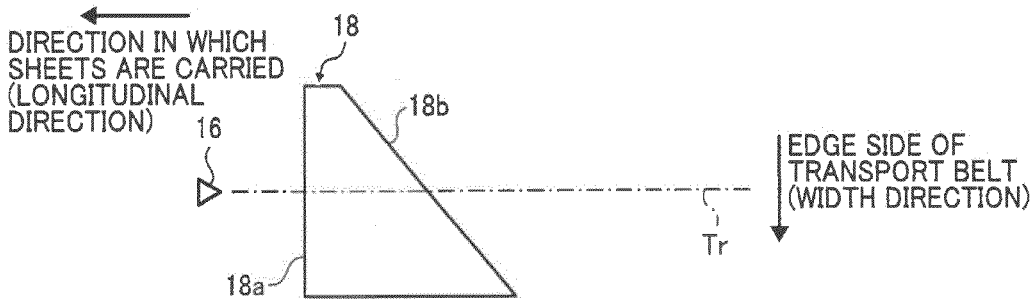

Various modifications of the first type of element to be detected can also be devised. As an example, the mark 18 as the first type of element to be detected may be tilted in a direction opposite to that of the second embodiment as shown in FIG. 24A. As another example, the positions of the marks 17 and 18 may be switched from those of the second embodiment as shown in FIG. 24B. As still another example, the mark 18 may be formed into a trapezoid as shown in FIG. 24C, or into a triangle (not shown). In either case, the direction of movement and the amount of movement of the transport belt 43 in its width direction may be determined based on a difference between times at which front and rear edges 18*a* and 18*b* of the mark 18 are detected. Here, the front and rear edges 18*a* and 18*b* correspond to the second and first types of elements to be detected, respectively. Although not shown, a mark may be formed into a stepped shape, in which the position of the mark in the width direction of the transport belt 43 changes in a stepwise manner in the longitudinal direction of the transport belt 43. Furthermore, when a fixed point (reference point) of a transport belt in its longitudinal direction relative to an image forming device is known, deformation of the transport belt in its width direction can be detected only from a result of detecting the first type of element to be detected.

According to the present invention, timing of preliminary discharge of ink droplets through the nozzles can be controlled in consideration of deformation of the transport belt such as a stretch, a contraction or an inclination based on the results of detecting the elements to be detected defined on the transport belt. Accordingly, ink droplets are allowed to precisely pass through the suction holes 201 serving as through holes, which makes it possible to enhance efficiency of preliminary discharge.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming device comprising:

an endless transport belt in which a plurality of through holes are formed, the transport belt circulating to carry sheets;

a recording head with a plurality of nozzles through which ink droplets are discharged, the nozzles being arranged in a width direction of the transport belt;

a sensor that detects at least one element to be detected formed on the transport belt when the transport belt circulates; and means for calculating a detected time difference between a time at which a first one of the elements to be detected is detected by the sensor and a time at which an adjacent, second one of the elements to be detected is detected by the sensor, controlling timings of discharge, in a preliminary discharge, of ink droplets from the nozzles into the through holes located in an area delimited between the first and second ones of the elements to be detected, based on a calculated difference between the detected time difference and an expected time difference, and based on distances of the through holes from the first one of the elements to be detected in a longitudinal direction of the transport belt, and performing the preliminary discharge of ink droplets through the nozzles into the through holes at the timings.

2. The image forming device according to claim 1, wherein the means for calculating further delays timings of discharge of ink droplets through one of the nozzles more largely with respect to initial values as a time difference determined by the results of detecting increases.

3. The image forming device according to claim 1, wherein the elements to be detected include ones arranged in a longitudinal direction of the transport belt, and the means for calculating further controls the timings based on results of detecting the ones of the elements to be detected.

4. The image forming device according to claim 3, further comprising means for controlling a means for producing an output indicative of an occurrence of an abnormality when a target value of comparison determined by the results of detecting the elements to be detected is the same as or greater than a first threshold.

5. The image forming device according to claim 4, further comprising means for storing the results of detecting the elements to be detected or the target value of comparison, wherein the means for storing includes a nonvolatile storage device.

6. The image forming device according to claim 3, further comprising means for stopping at least part of operation of the image forming device when a target value of comparison determined by the results of detecting the elements to be detected is the same as or greater than a second threshold.

7. The image forming device according to claim 3, further comprising:

means for controlling a means for producing an output indicative of an occurrence of an abnormality when a target value of comparison determined by the results of detecting the elements to be detected is the same as or greater than a first threshold; and means for stopping at least part of operation of the image forming device when the target value of comparison determined by the results of detecting the elements to be detected is the same as or greater than a second threshold, and wherein the second threshold is greater than the first threshold.

8. The image forming device according to claim 1, wherein the expected time difference is between times at which the first and second ones of the elements to be detected are detected in an initial state in which no deformation is generated in the transport belt.

9. The image forming device according to claim 8, wherein the means for calculating further delays the timings when a value obtained by subtracting the expected time difference from the detected time difference is negative, and advances the timings when a value obtained by subtracting the expected time difference from the detected time difference is positive.

10. The image forming device according to claim 1, wherein the elements to be detected include ones arranged in the width direction of the transport belt; and the means for calculating further controls the timings based on results of detecting the ones of the elements to be detected.

11. The image forming device according to claim 10, further comprising:

means for storing at least one of a first threshold and a second threshold; and means for changing at least one of the first threshold and the second threshold stored by the means for storing.

12. The image forming device according to claim 1, further comprising:

means for selecting at least one from the nozzles for the preliminary discharge into each of the through holes, the selection being made based on a result of detecting a first type of element to be detected, given from the sensor, the first type of element to be detected included in the elements to be detected, the sensor detecting a position of the first type of element to be detected in the width direction of the transport belt changing in the longitudinal direction of the transport belt.

13. The image forming device according to claim 12, wherein: the first type of element to be detected is arranged in a position in which the first type of element to be detected is detected later by the sensor as the first type of element to be detected goes closer to one side of the width direction of the transport belt, and selecting, by the means for selecting, as the first type of element to be detected is detected at a later time by the sensor, at least one from the nozzles, which is to be used for discharge of ink droplets into each of the through holes, the selected at least one having a longer distance from that used in an initial state towards another side of the width direction of the transport belt.

14. The image forming device according to claim 13, wherein a distance in the longitudinal direction of the transport belt between a detected position of the first type of element to be detected and a detected position of a second type of element to be detected included in the elements to be detected is set longer as the detected positions go closer to one side of the width direction of the transport belt; and selecting, by the means for selecting, as a difference between times at which the first type of element to be detected and the second type of element to be detected are detected by the sensor becomes greater, at least one from the nozzles, which is to be used for discharge of ink droplets into each of the through holes, the selected at least one having a longer distance from that used in an initial state toward another side of the width direction of the transport belt.

15. The image forming device according to claim 13, further comprising means for controlling a means for producing an output indicative of an occurrence of an abnormality when a target value of comparison determined by a result of detecting the first type of element to be detected is the same as or greater than a third threshold.

16. The image forming device according to claim 15, further comprising means for storing the result of detecting the first type of element to be detected or the target value of comparison, wherein the means for storing includes a nonvolatile storage device.

17. The image forming device according to claim 15, further comprising:

means for storing at least one of third and fourth thresholds; and means for changing at least one of the third and fourth thresholds stored by the means for storing.

18. The image forming device according to claim 13, further comprising means for stopping at least part of the operation of the image forming device when a target value of comparison determined by a result of detecting the first type of element to be detected is the same as or greater than a fourth threshold.

19. The image forming device according to claim 13, further comprising:

means for controlling a means for producing to produce an output indicative of an occurrence of an abnormality when a target value of comparison determined by a result of detecting the first type of element to be detected is the same as or greater than a third threshold; and means for stopping at least part of the operation of the image forming device when a target value of comparison determined by a result of detecting the first type of element to be detected is the same as or greater than a fourth threshold, and wherein the fourth threshold is greater than the third threshold.

20. An image forming device comprising:

an endless transport belt in which a plurality of through holes are formed, the transport belt circulating to carry sheets;

a recording head with a plurality of nozzles through which ink droplets are discharged, the nozzles being arranged in a width direction of the transport belt;

a sensor that detects elements to be detected formed on the transport belt when the transport belt circulates, the elements to be detected including a first type of elements to be detected, position of the first type of elements to be detected being detected in the width direction of the transport belt changing in a longitudinal direction of the transport belt; and means for calculating a detected time difference between a time at which a first one of the first type of elements to be detected is detected by the sensor and a time at which an adjacent, second one of the first type of elements to be detected is detected by the sensor, controlling timings of discharge, in a preliminary discharge, of ink droplets from the nozzles into the through holes located in an area delimited between the first and second ones of the elements to be detected, based on a calculated difference between the detected time difference and an expected time difference, and based on distances of the through holes from the first one of the first type of elements to be detected in a longitudinal direction of the transport belt, and performing the preliminary discharge of ink droplets through the nozzles into the through holes at the timings.

* * * * *